US011631310B2

(12) United States Patent
Meehan et al.

(10) Patent No.: US 11,631,310 B2
(45) Date of Patent: Apr. 18, 2023

(54) EAS SECURITY SYSTEM INCORPORATING TIME OF FLIGHT SENSING

(71) Applicant: Control Group Companies LLC, Bridgewater, NJ (US)

(72) Inventors: Thomas J. Meehan, Woodcliff Lake, NJ (US); Mikko Tapio Lähteenmäki, Raisio (FI); Toni Johannes Heijari, Kalanti (FI); Sami Petteri Ruotsalainen, Halikko As (FI); Artan Vatoci, Whippany, NJ (US); Brian M. Diplock, Far Hills, NJ (US)

(73) Assignee: Control Group Companies LLC, Bridgewater, NJ (US)

( * ) Notice: Subject to any disclaimer, the term of this patent is extended or adjusted under 35 U.S.C. 154(b) by 0 days.

(21) Appl. No.: 17/876,018

(22) Filed: Jul. 28, 2022

(65) Prior Publication Data

US 2023/0035891 A1 Feb. 2, 2023

Related U.S. Application Data

(60) Provisional application No. 63/227,103, filed on Jul. 29, 2021.

(51) Int. Cl.
*G08B 13/24* (2006.01)

(52) U.S. Cl.
CPC ..... *G08B 13/248* (2013.01); *G08B 13/2462* (2013.01)

(58) Field of Classification Search
CPC ..... G08B 13/2402; G08B 13/2448; G08B 13/2462; G08B 13/2485; G08B 13/2488; G08B 13/246
See application file for complete search history.

(56) References Cited

U.S. PATENT DOCUMENTS

| | | | | |
|---|---|---|---|---|
| 8,477,032 | B2 | 7/2013 | Bergman et al. | |
| 9,519,811 | B1 * | 12/2016 | Simon | G06K 7/10306 |
| 2016/0093182 | A1 * | 3/2016 | Turgeon | G08B 13/2402 340/572.1 |
| 2020/0079412 | A1 | 3/2020 | Ramanathan et al. | |
| 2021/0082277 | A1 * | 3/2021 | Riggert | G08B 13/2482 |
| 2022/0057519 | A1 * | 2/2022 | Goldstein | G01S 17/04 |
| 2022/0223019 | A1 * | 7/2022 | Shakedd | G06Q 20/327 |

OTHER PUBLICATIONS

International Search Report and Written Opinion issued in Appln. No. PCT/US2022/038663 dated Dec. 2, 2022 (16 pages).

* cited by examiner

*Primary Examiner* — Mirza F Alam
(74) *Attorney, Agent, or Firm* — Lerner David LLP

(57) ABSTRACT

An electronic article surveillance (EAS) system and method of operating the system, including one or more processors and memory. The memory contains instructions to cause the processors to receive data from a first sensor indicating the presence of an electronic surveillance tag within a first predetermined space, receive data from a second sensor including tracking information that indicates a distance of the second sensor from a person in possession of the electronic surveillance tag within a second predetermined space, determine a speed and/or direction of movement of the person based on the data from the second sensor, and detect a theft event and execute an alarm routine based on the presence of the electronic surveillance tag within the first predetermined space and the speed and/or direction of movement of the person within the second predetermined space.

30 Claims, 10 Drawing Sheets

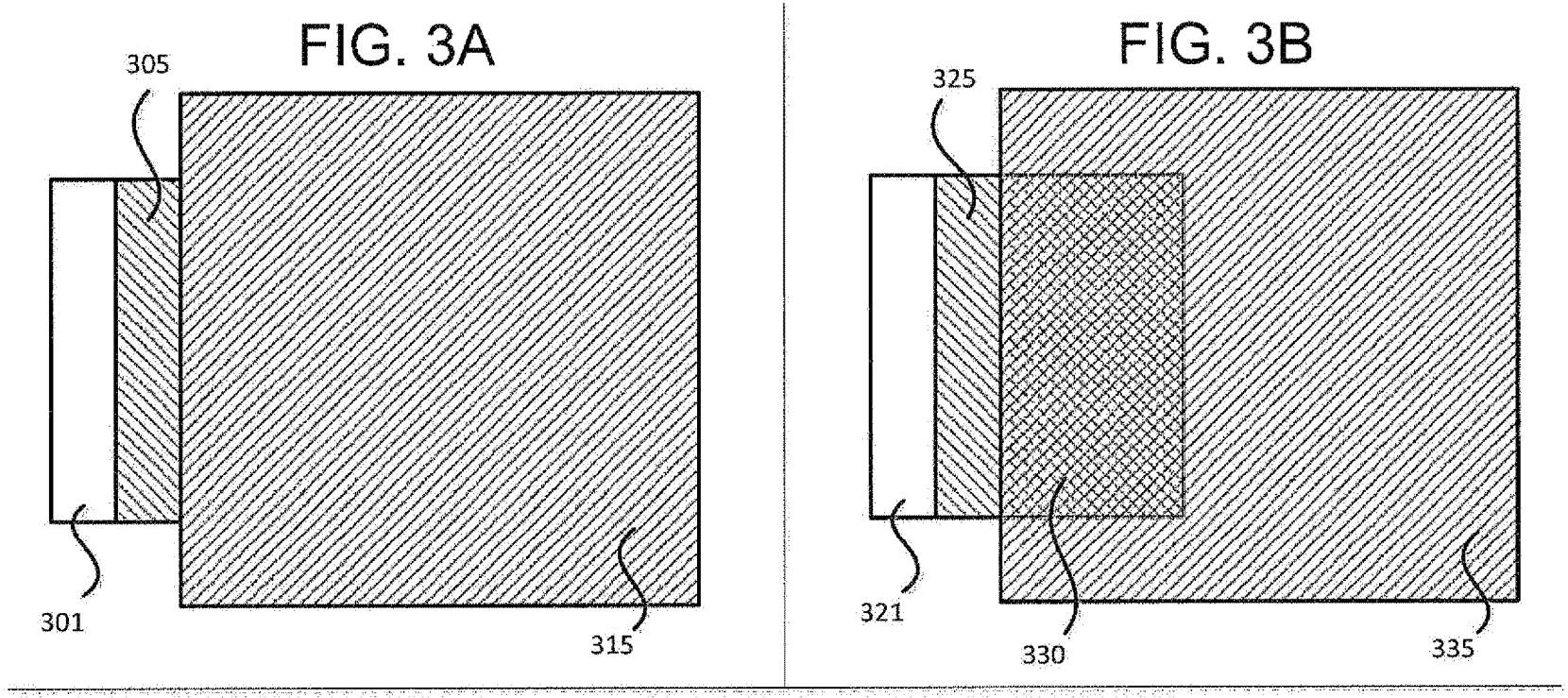
FIG. 3A
FIG. 3B
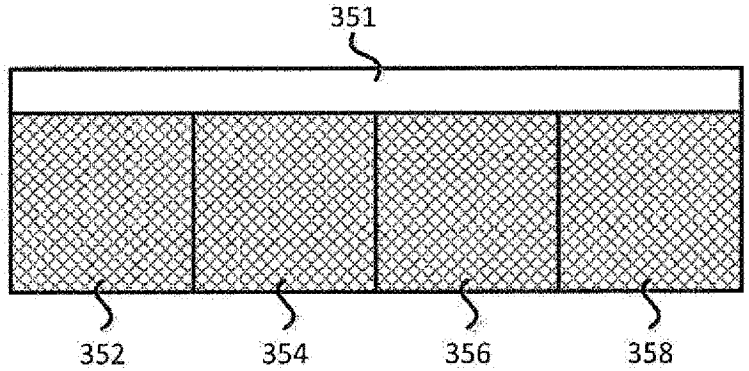
FIG. 3C

800

EAS SECURITY SYSTEM INCORPORATING TIME OF FLIGHT SENSING

CROSS-REFERENCE TO RELATED APPLICATION

The present application claims the benefit of the filing date of U.S. Provisional Patent Application No. 63/227,103 filed Jul. 29, 2021, the disclosure of which is hereby incorporated herein by reference.

BACKGROUND

Electronic Article Surveillance (EAS) systems typically include a tag that is activated by passing through a surveilled area, such as close to a tag sensor or through a gate. Surveilled areas may be strategically positioned, such as at or close to an exit of a store or shopping area, in order to prevent shoplifting. Passing through the surveilled area with an activated tag triggers an alarm, and notifies security workers or store employees of a potential theft.

One potential drawback of EAS systems is that the systems are prone to triggering the alarm even when a customer does not intend to shoplift. For example, a customer standing close to an exit with an activated tag but with no intent to exit the store may inadvertently trigger the alarm. As a further example, a customer walking across a store may pass right in front of an exit and inadvertently trigger the alarm. These false alarms are a nuisance for both customers and store employees.

One approach to reducing EAS system false alarms is to position the surveillance area as close as possible to the exit, or even outside the store entirely. This would ensure that customers standing close to the exit or walking in front of the exit would not inadvertently trigger the alarm unless they are right at the exit or even outside the store. However, this approach has its own drawbacks. Positioning the surveillance area closer to the exit means that it takes less time for a shoplifter to get away after the alarm is triggered. This means that shoplifters who run through the surveillance area may have already gotten away before the alarm is even triggered.

BRIEF SUMMARY

The present disclosure provides an EAS system that is capable of monitoring a surveillance area with reduced false alarms but without having to position the surveillance area as close as possible to, or even outside, the exit. This is accomplished by pairing the EAS tag sensor of the surveilled area with a motion sensor for tracking speed, distance and directionality of people passing through the surveilled area.

One aspect of the present disclosure provides an electronic article surveillance (EAS) system including one or more processors and memory in communication with the one or more processors. The memory contains instructions configured to cause the one or more processors to receive first sensor data from a first sensor, the first sensor data indicating the presence of an electronic surveillance tag within a first predetermined space, receive second sensor data from a second sensor, wherein the second sensor data includes information that indicates a distance of the second sensor from a person in possession of the electronic surveillance tag within a second predetermined space, determine a speed of movement of the person based on multiple data inputs from the second sensor data, and detect a theft event and execute an alarm routine of the EAS system based on the presence of the electronic surveillance tag within the first predetermined space and the speed of movement of the person within the second predetermined space.

Another aspect of the disclosure is directed to an EAS system including a first sensor positioned at a first surveilled exit and configured to detect one or more electronic surveillance tags within a first predetermined space, and transmit first sensor data to a control circuit, the first sensor data indicating detection of an electronic surveillance tag within the first predetermined space, a second sensor positioned at the first surveilled exit and configured to obtain information of one or more persons within a second predetermined space, the information at a given moment of time indicating a distance between the second sensor and a detected person at the given moment of time, and transmit second sensor data to the control circuit, the second sensor data includes multiple inputs collected over a duration of time indicating a change in distance of the detected person over a duration of time, and an alarm configured to receive, from the control circuit, an alarm activation instruction in response to the transmitted first and second sensor data indicating a theft event.

Yet another aspect of the disclosure is directed to a method including: receiving, by one or more processors, first sensor data from a first sensor, the first sensor data indicating the presence of an electronic surveillance tag within a first predetermined space of a surveilled area; receiving, by the one or more processors, second sensor data from a second sensor, the second sensor data including information that indicates a distance of the second sensor from a person in possession of the electronic surveillance tag within a second predetermined space of the surveilled area; determining, by the one or more processors, a speed of movement of the person based on the second sensor data; detecting, by the one or more processors, a theft event based on the presence of the electronic surveillance tag within the first predetermined space and the speed of movement of the person within the second predetermined space; and issuing, by the one or more processors, an alarm activation instruction upon detection of the theft event.

BRIEF DESCRIPTION OF THE DRAWINGS

FIGS. 3A-3C are diagrams of example sensor unit coverage maps from an overhead perspective.

DETAILED DESCRIPTION

Figure 1:
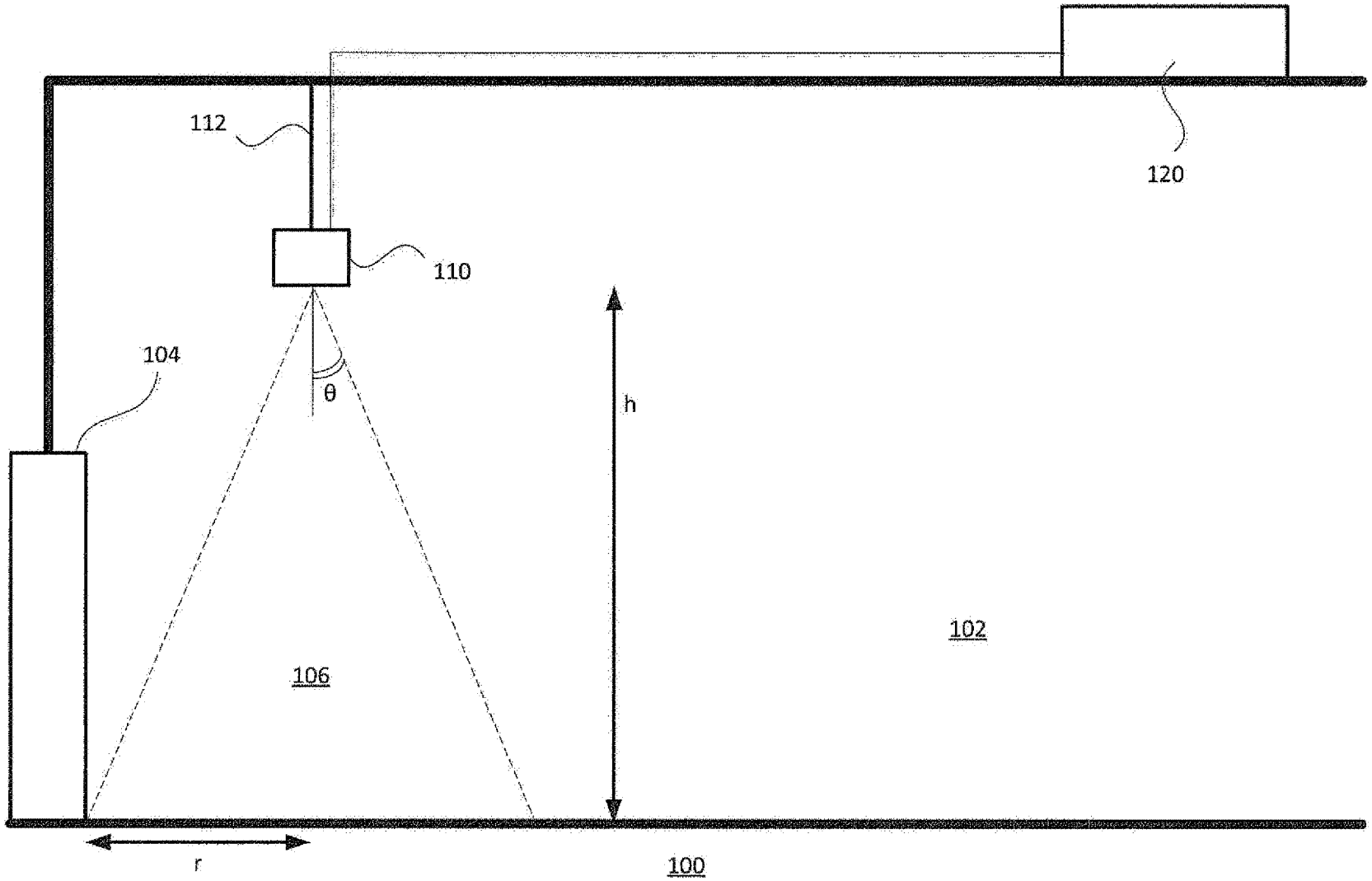
FIG. 1 is a block diagram of a system in a shopping area in accordance with an aspect of the disclosure.

An EAS system of the present disclosure includes both an EAS tag sensor to detect the presence of an EAS tag within a surveilled area and a motion sensor for tracking a speed, distance and directionality of people within the same or a different surveilled area. The motion sensor may be capable of tracking any one or combination of a person's speed, direction or change of direction as the person moves through the surveilled area. This allows the system to distinguish people who are shoplifting threats (e.g., a person running near an exit, a person near an exit running towards the exit, a person near an exit abruptly turning in a direction towards the exit, etc.) from people who are not threats (e.g., a person crossing in front of an exit, a person standing near an exit, etc.).

The motion sensor may be a light beam-based sensor such as Lidar. The light-beam sensor has a relatively fast response time, meaning that a person's speed, direction, change of direction, or any combination of the above, can be quickly derived from the time-of-flight information, and a determination of whether the person's motion amounts to a potential theft or shoplifting event can be made in relatively little time.

The surveilled areas of each of the tag sensor and the motion sensor may completely overlap, partially overlap, or not overlap at all with each other. For instance, in a partially overlapping or non-overlapping arrangement, the tag sensor may be configured to monitor an area relatively closer to the exit, and the motion sensor may be configured to monitor an area relatively farther from the exit. In such an arrangement, a person's speed heading toward an exit may already be derived from time-of-flight data before the person even steps within range of the tag sensor. Thus, the previously derived speed of the person may be used to determine whether or not the tag sensor should trigger the alarm in response to sensing an activated tag that the person is carrying.

The surveillance systems may include or be connected to one or more control units for processing collected sensor data and determining whether the sensor data indicates a risk of a shoplifting or theft event. The control units may be capable of combining data from the various sensors, and optionally from other control units, in order to monitor the entire surveilled area as a single area. Additionally or alternatively, surveillance systems may be positioned at different exits, and one or more control units may be capable of communicating with the various surveillance systems. For instance, the control unit may keep track of which exits are associated with each surveillance system, so that sensor data from a tag sensor at one exit is not evaluated in combination with sensor data from a motion sensor at a different exit.

In some examples, sensor data may be continuously provided from the sensors to the control unit for processing. Alternatively, one sensor may be used to activate another sensor, whereby the other sensor begins providing data to the control unit after activation. For instance, the motion sensor may begin providing time-of-flight data after a tag has been sensed by the tag sensor, or vice versa.

Ultimately, the example systems and devices of the present disclosure reduce false alarms since people moving slowly or in a direction other than towards an exit do not trigger an alarm. This improvement reduces frustration for shoppers and store employees. Additionally, this improvement allows for the above-described EAS system to be positioned further inside a store or shopping area, meaning that shoplifters moving quickly towards an exit are detected before they are able to exit the store or shopping area, and an alarm can be triggered in time for security workers to approach the shoplifter.

FIG. 1 is a block diagram of an electronic article surveillance (EAS) system 100 for detecting and preventing shoplifting. The system 100 is designed to monitor a shopping area 102, such as a store. In the illustration of FIG. 1, a single exit 104 from the shopping area 102 is shown, although the shopping area 102 may have additional exits. It should be understood that the term "exit" as used herein includes both entrances and exits, since entrances are potential exit points for shoplifters and must be monitored like an exit.

FIG. 1 also shows a predetermined surveilled area 106 in front of the exit 104. The surveilled area 106 may include any location within a detection range of one or more sensor units 110. The sensor unit 110 is positioned to detect both people and objects bearing EAS tags that enter the surveilled area 106. In the example of FIG. 1, the sensor unit 110 is suspended from a ceiling of the shopping area 102 by a cable 112. The size of the surveilled area, which is shown in FIG. 1 as having a radius (r), may be controlled based on the height (h) of the sensor unit 110 and an angle of view (θ) of the sensors included in the sensor unit 110. The radius (r) can be calculated as the product of $h*\tan(\theta)$. Additionally, the height (h) can be selected so that the farthest distance monitored by the sensors at the perimeter of the monitored area is no farther than a maximum range of the sensors included in the sensor unit 110. For instance, for a sensor unit including a sensor having an angle of view of 40° and a maximum range of 4 meters, the sensor unit may be suspended 3 meters above the floor. This would result in a radius of about $3*\tan(40°)=2.5$ meters. Additionally, the farthest point of the monitored area would be $\mathrm{sqrt}((3)^2+(2.5)^2)=3.9$ meters, which is within the maximum range of 4 meters. In the example of FIG. 1, sensor unit 110 is positioned between 8-15 feet above the floor of the shopping area, and in some instances between 13-15 feet, and can detect a person within about a six-foot radius of a point on the floor directly below the sensor unit 110.

The system 100 may further include a controller 120 for processing signals from the sensor unit 110, detecting a theft event based on the processed signals, and executing an alarm routine of the system in response to detection of a theft event. The controller 120 may be included with the sensor unit 110 or may be remote from the sensor unit and connected by a wired or wireless connection, or any combination thereof. In the example of FIG. 1, the controller 120 is shown as being remote from the sensor unit 110 and connected by a wire.

Figure 2:
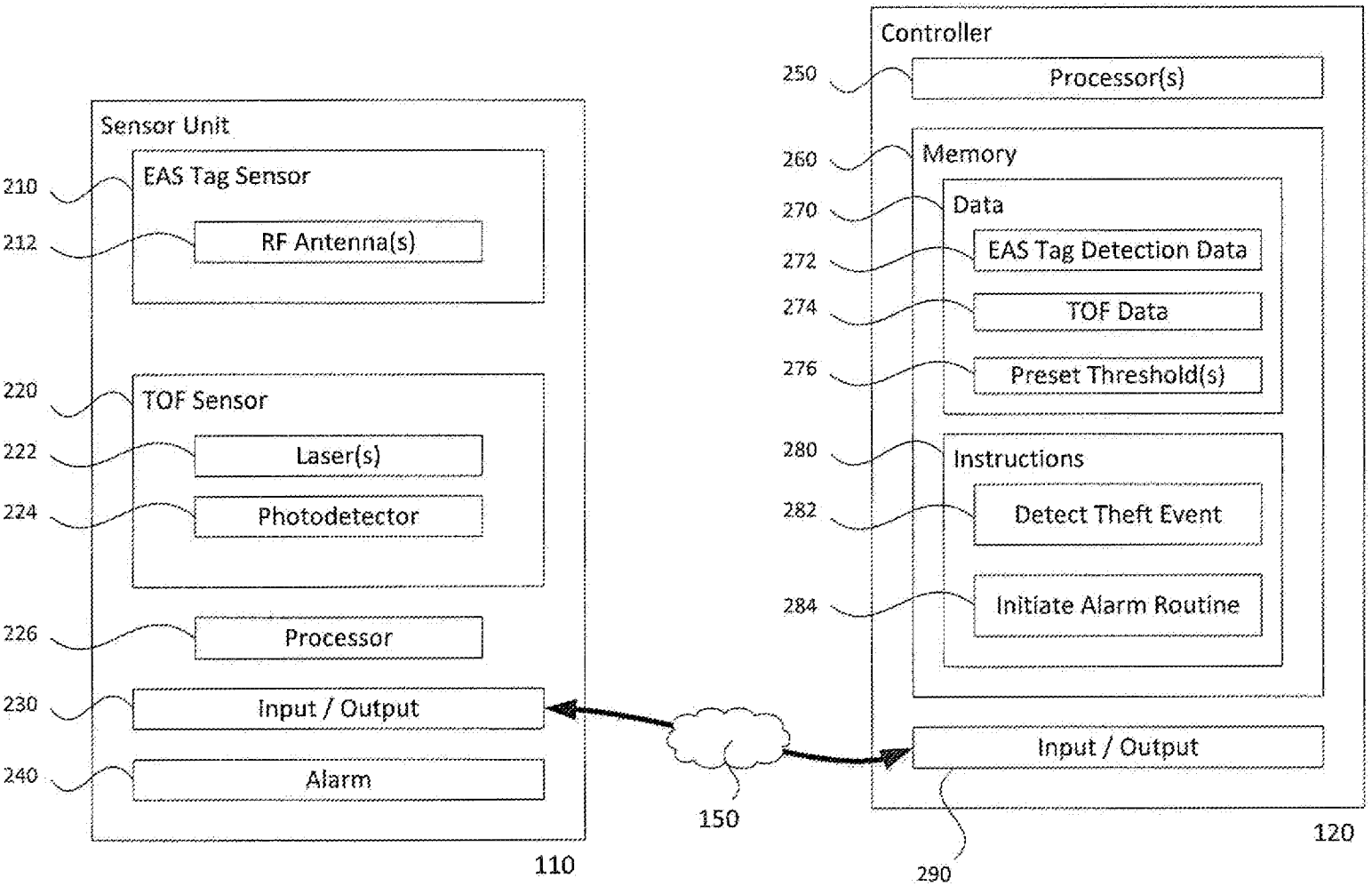
FIG. 2 is a block diagram of an example sensor unit and controller for use in the system of FIG. 1.

Additional details of the sensor unit 110 and controller 120 are shown in the block diagram of FIG. 2. The sensor unit 110 in FIG. 2 includes both a first sensor 210 which is an EAS tag sensor, and a second sensor 220 which is a time-of-flight (TOF) motion sensor. Also, in some arrangements, the tag sensor and motion sensor may be housed in a surveillance unit having a common housing. The surveillance unit may be suspended a predetermined distance above the ground in order to provide surveillance coverage over a certain radius around a point on the floor directly below the sensors. Multiple surveillance units may be suspended, such as in an array, in order to provide wider surveillance coverage of an area in front of an exit.

The EAS tag sensor 210 may be capable of detecting EAS tags, and by extension objects attached to the EAS tags such as articles for sale, within a predetermined area. The EAS tag sensor may include one or more antennas 212, such as radio frequency (RF) antennas that are capable of emitting an RF signal. The antennas 212 may be capable of interacting with a passive EAS tag, such as an acousto-magnetic tag or a radio frequency identification (RFID) tag, whereby interaction with the passive tag may be detected by the antennas 212. In this manner, the EAS tag sensor 210 is capable of detecting when a passive tag is within the sensor's range. In other examples, one or more antennas of an EAS tag sensor may be configured to detect active RF tags, whereby the EAS tags are capable of emitting RF signals on their own and the one or more antennas function as receivers to detect the emitted signals and thus the EAS tags. In yet a further example, the EAS tag sensor may be a Bluetooth reader configured to receive RF signals emitted from a Bluetooth tag. Either one of active or passive Bluetooth scanning, for both standard Bluetooth transmissions and Bluetooth Low Energy (BLE) transmissions, may be used to communicate between the Bluetooth reader and the tag. Typically, the RF signals used in the acousto-magnetic or RFID tag may be on the order MHz, whereas the RF signals used in the Bluetooth tag may be on the order to GHz.

The TOF sensor 220 may be capable of detecting and tracking movement of a person within a predetermined area. In one example, the TOF sensor 220 may use Lidar in order to track the person's movements. In such an example, the TOF sensor may include one or more lasers 222 and one or more photodiodes or photodetectors 224. The lasers 222 may be configured to emit a light beam that reflects off of an object in the predetermined area and back towards the photodetector 224. For example, the TOF sensor may be a sensor from the VL53 line of sensors made by STMicroelectronics may be included in the sensor unit.

The sensor unit 110 may further include one or more processors 226 that may be configured to receive sensor data from the RF antennas 212, photodetector 224 or both, and to determine movements of a detected person based on changes in the sensor data over time. The processors may include one or more microcontrollers, digital signal processors, or other hardware-based processing devices, and may include dedicated components such as an application-specific integrated circuit ("ASIC"). The sensor data processed by the one or more processors 226 can be used to derive a speed of the detected person, a direction of travel, or both.

In some examples, the EAS tag sensor 210, the TOF sensor 220, or both may include beam steering technology to provide accurate detection and tracking of people moving through a surveilled area. Beam steering can ensure with greater accuracy whether or not a detected person is still within the surveilled area or has moved out of the area. The tag sensor in conjunction with the TOF sensor can use one or both of a received signal strength indicator (RSSI) or real-time location system (RTLS) data to control the in-field steering of the beam.

The sensor unit 110 may further include one or more input and/or output connections 230 for sending/receiving data. The input and output connections 230 may be used to communicate with other sensor units and controllers, as well as other remote devices. Such communications can be transmitted and received over a network 150 using various configurations and protocols, including but not limited to short-range communication protocols such as near-field communication (NFC), Bluetooth™ or Bluetooth™ Low Energy (LE) communications, an intranet connection, an Ethernet connection, a Wi-Fi connection, a local network, an internet connection, HTTP, a virtual private network, a wide area network, other private networks using proprietary communication protocols, or any combination thereof.

The sensor unit 110 also includes an alarm 240 capable of being activated in order to indicate that a theft event is occurring. The alarm 240 may include visual alerts such as flashing or blinking lights, audio alerts such as a recorded message or siren, or both. Additionally or alternatively, the alarm 240 may include other functions, such as transmitting a communication indicating the theft event to a remote area such as a security desk or a remote log of activity, or such as controlling an ability to freely enter or exit the shopping area, such as automatically locking the exit. Such communications can be transmitted through the input and output connections 230 of the sensor unit, and optionally over the network 150.

The sensor unit 110 may also include a housing in which each of the EAS tag sensor 210, the TOF sensor 220, the input and output connections 230 and the alarm 240 may be housed.

Each of the EAS tag sensor 210 and the TOF sensor 220 of the sensor unit 110 may be configured to monitor a predetermined space at or next to the exit to the shopping area. For instance, in FIG. 1, a surveilled area 106 close to exit 104 is monitored by both the EAS tag sensor 210 and the TOF sensor 220 of the sensor unit 110. Thus, in the example of FIG. 1, the predetermined spaces monitored by the two sensors fully overlap with one another. However, in other instances, the sensors may monitor partially overlapping regions or non-overlapping regions. In other instances, the space monitored by the EAS tag sensor may be fully within the space monitored by the TOF sensor, but not vice versa. Additionally, in the example arrangement of FIG. 2, a single EAS tag sensor 210 and a single TOF sensor 220 are shown. However, in other arrangements, multiple EAS tag sensors and/or multiple TOF sensors may be provided.

As previously noted, the EAS tag sensor 210 includes one or more radio frequency (RF) antennas 212. In those sensors including multiple RF antennas, the antennas may be arranged as a phased array, whereby a phase of each of the RF antennas may be controlled in order to steer one or more RF beams emitted from the sensor to radio frequency identification (RFID) tags within the range of the sensor. Each antenna beam emitted by a transmitter of the sensor may be sensed by an RFID tag, which in turn may transmit back an RF signal towards a receiver of the sensor. The received RF data can then be processed to determine such information as the presence and location of a detected RFID tag.

The TOF sensor 220 includes one or more emitters configured to emit light beams. The light beams emitted from the TOF sensor 220 are capable of tracking moving objects within the range of the sensor 220. A light beam emitted by the emitter may be reflected by an object back towards a photodetector of the sensor 220. The sensed light data can be processed to determine such information as the presence and location of an object within range of the sensor 220.

FIGS. 3A-3C are diagrams illustrating coverage areas for a few example arrangements of EAS tag sensors and TOF sensors. It should be understood that the example arrangements are not an exhaustive list of arrangements, and any number of other sensor arrangements may be used.

In FIG. 3A, a surveilled area at an exit 301 of a shopping area includes non-overlapping regions monitored by an EAS tag sensor and a TOF sensor, respectively. The EAS tag sensor is positioned to monitor a first region 305 at or immediately inside of the exit. The TOF sensor is positioned to monitor a second region 315 interior to the first region, such as a lobby area just prior to the exit. In such an arrangement, the TOF sensor may first detect a person moving through the second region 315. Then, if the person moves from the second region 315 into the first region 305 in order to exit the shopping area while carrying an EAS tag, the EAS tag sensor may detect the presence of the tag. The combination of these two detections, along with other determinations such as the person moving in a suspicious manner, may trigger an alarm at the sensor unit or elsewhere.

In FIG. 3B, a surveilled area at an exit 321 of a shopping area includes overlapping regions monitored by an EAS tag sensor and a TOF sensor, respectively. The EAS tag sensor is positioned to monitor the first region 325 at or immediately in front of the exit. The TOF sensor is positioned to monitor the second region 335. At least part of the second region 335 overlaps with the first region 325 to form an overlapping region 330. A remaining part of the second region 335 is interior to the first region. In such an arrangement, the TOF sensor may first detect a person moving through the second region 335. Then, if the person moves from the second region 335 into the overlapping region 330 or the first region 325 in order to exit the shopping area while carrying an EAS tag, the EAS tag sensor may detect the presence of the tag. The combination of these two detections, along with other determinations such as the person moving in a suspicious manner, may trigger an alarm at the sensor unit or elsewhere.

In FIG. 3C, a shopping area includes two separate exits 341, 351. In the example of FIG. 3C, the exits 341, 351 are shown as being close together and on a same side of the shopping area, but in other arrangements the exits may be on different sides, may be spaced farther apart, or both. Each exit is relatively wide, and may be too wide to allow for monitoring by a single sensor unit. In order to monitor the entire width of each exit, a plurality of sensor units are positioned along the width of each exit. Sensor units 342, 344, 346 and 348 are positioned across the first exit 341, and sensor units 352, 354, 356 and 358 are positioned across the second exit 351. Thus, each exit may be associated with a respective group of sensor units. Each respective group of sensor units 342/344/346/348 or 352/354/356/358 may be communicatively connected to one another in order to function as an array, whereby measurements collected at one sensor unit can be combined with or compared to measurements from another sensor unit in order to detect changes in a person's movement throughout the area surveilled by the group of sensor units. A processor of one sensor unit of the group may be designated as a master controller, and the processors of the other sensor units as slave controllers.

In the example of FIG. 3C, each shaded area represents a different sensor unit, whereby each sensor unit includes its own respective EAS tag sensor and TOF sensor. Each of the eight sensor units monitors its own respective common predetermined area. In some examples, the sensors of each sensor unit may monitor the same area as one another. In other examples, the sensors of a given sensor unit may monitor non-overlapping areas. For instance, the arrangements shown in FIGS. 3A and 3B may be extended to cover a wider exit by providing multiple first regions of EAS tag monitoring and multiple second regions of TOF monitoring.

Returning to FIG. 2, the controller 120 of the surveillance system 100 may include each of a processor 250, memory 260, and input/output connections 290 for communication with the sensor unit 110.

The processor 250 may be a well-known processor or other lesser-known types of processors. Alternatively, the processor 250 can be a dedicated controller such as an ASIC. The memory 260 can store information accessible by the processor 250, including data 270 that can be retrieved, manipulated or stored by the processor 250, in accordance with instructions 280 stored in the memory. The memory 260 may be a type of non-transitory computer readable medium capable of storing information accessible by the processor 250, such as a hard-drive, solid state drive, tape drive, optical storage, memory card, ROM, RAM, DVD, CD-ROM, write-capable, and read-only memories.

Although the system described herein is not limited by a particular data structure, the data 270 may be stored in computer registers, in a data store as a structure having a plurality of different fields and records, or documents, or buffers. The data 270 may also be formatted in a computer-readable format such as, but not limited to, binary values, ASCII or Unicode. Moreover, the data 270 can include information sufficient to identify relevant information, such as numbers, descriptive text, proprietary codes, pointers, references to data stored in other memories, including other network locations, or information that is used by a function to calculate relevant data. The instructions 280 may be a set of instructions executed directly, such as machine code, or indirectly, such as scripts, by the processor 250. In this regard, the terms "instructions," "steps," "programs" and "routines" can be used interchangeably herein.

Although FIG. 2 functionally illustrates the processor 250 and memory 260 as being within the same controller block 120, the processor 250 and memory 260 may actually include multiple processors and memories that may or may not be stored within the same physical housing. For example, some of the data 270 and instructions 280 may be stored on a removable storage device such as a CD-ROM. Also, some or all of the instructions and data can be stored remote from the processor 250, but may be accessed remotely, such as over the network 150. Additionally, the processor 250 can actually include a collection of processors, which may or may not operate in parallel.

In the example of FIG. 2, the data 270 may include information for detecting and interpreting movements within the predetermined space monitored by the sensor unit 110. For example, the data 270 may include EAS tag detection data 272 indicating the presence of an EAS tag within a predetermined space associated with the EAS tag sensor 210. For further example, the data 270 may include time-of-flight data (TOF data) 274 indicating a velocity of a person moving through a predetermined space associated with the TOF sensor 220. For further example, the data 270 may include one or more preset thresholds 276, such as values against which the TOF data can be compared. One example stored threshold may be a threshold speed, such as 4 mph, 5 mph, 6 mph, or any other speed that would raise suspicion of a theft event occurring. Detecting a person moving faster than the threshold speed in a direction toward the exit may trigger an instruction for activating the alarm 240. Another example stored threshold may be a threshold change in direction angle, such as 30 degrees, 45 degrees, 60 degrees, 90 degrees, or any other change in direction that would raise suspicion of a theft event occurring. Detecting a person moving towards the exit after changing direction by an angle greater than the threshold angle may trigger an instruction for activating the alarm 240.

The instructions 280 included in the memory 260 of the controller 120 may include, among other functions, a theft event detection module 282 and an alarm routine initiation module 284. The theft event detection module 282 may be used to interpret the EAS tag detection data 272 and TOF data 274 received by the controller in order to determine whether there is an occurrence or potential occurrence of a theft event. Routines for interpreting sensor data and activating an alarm are provided herein.

The controller 120 may communicate with one or more sensor units 110 over the network 150 via the input/output connections 290. Further, the controller 120 may receive, store and assign groupings of multiple sensor units via the input/output connections 290. The groupings may be communicated to the sensor units using a group communication network protocol such as Message Queuing Telemetry Transport (MQTT). The controller 120 may further receive, store and assign alarming instructions and parameters via input/output connections 290. The input/output connections 290 may further facilitate communication with a user to provide user management of the system 100 through the controller 120.

Figure 4:
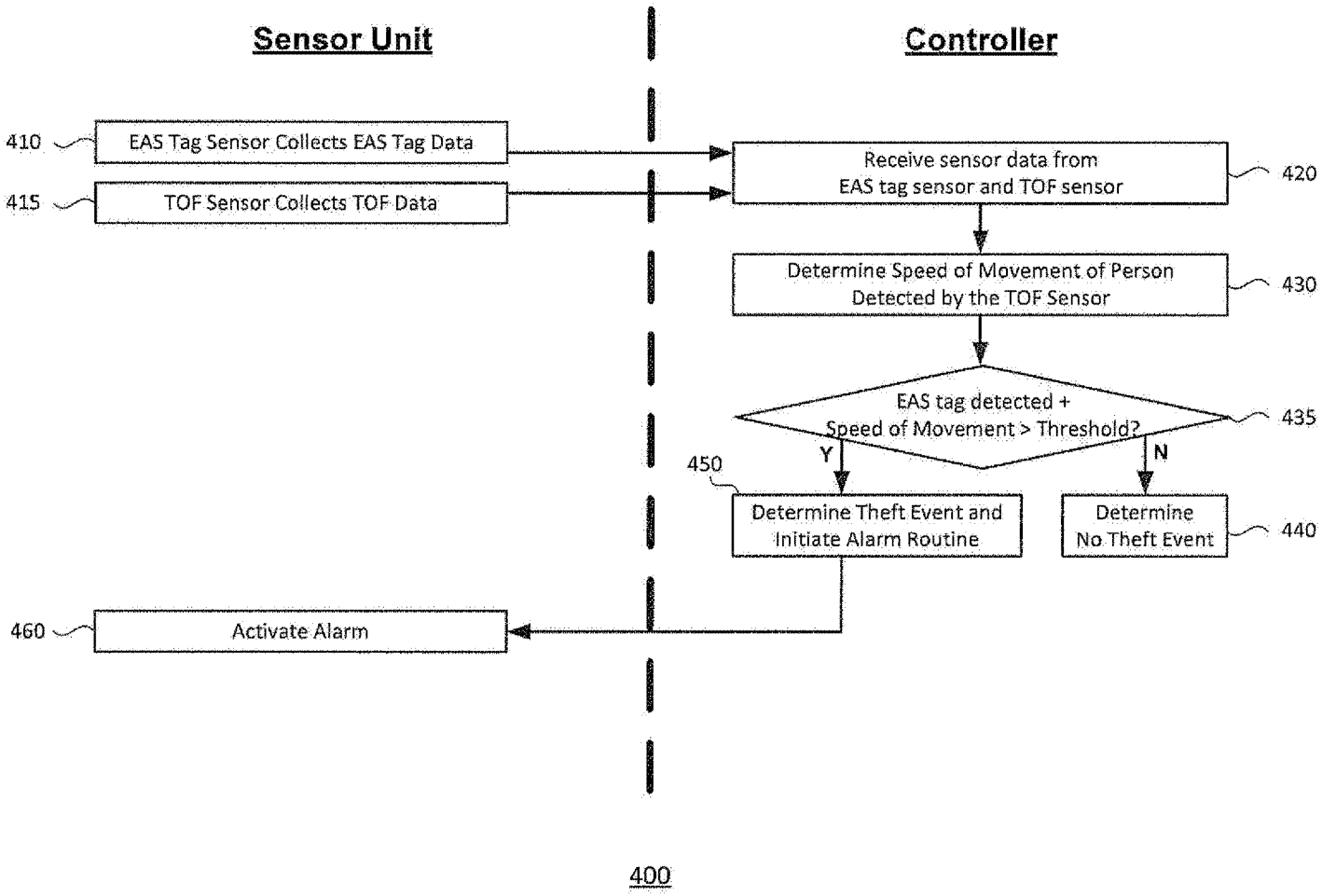
FIG. 4 is a flow diagram of an example method in accordance with an aspect of the disclosure.

FIG. 4 is a flow diagram showing an example routine 400 for monitoring a surveillance area with reduced false alarms based on speed of movement. At least some of the operations in the routine 400 may be carried out by computing device(s) of the system electronics, such as the sensor unit processor 226 and the controller processor 250 of FIG. 2. It should be understood that in other examples, steps may be added, subtracted, replaced or reordered.

At block 410, the EAS tag sensor 210 of the sensor unit 110 collects EAS tag data 272. For instance, the EAS tag sensor may be an EAS gate configured to emit a radio frequency signal, and may detect, in response to emitting the radio frequency signal, a passive RFID tag within a first predetermined space, such as a space within a predetermined range or radius of the EAS gate. In other instances, the EAS tag sensor may receive one or more signals from active tags within a predetermined range. Detecting an active or passive tag may indicate the presence of an article attached to the tag within the first predetermined space. The presence of the article within the first predetermined space may indicate the potential for a shoplifting event, but may not be sufficient to activate an alarm, since activating an alarm every time a tag were to enter the first predetermined space would result in an undue number of false alarms.

At block 415, the TOF sensor 220 of the sensor unit 110 collects TOF data 274. For instance, the TOF sensor may be a Lidar sensor configured to emit a light beam, and may detect light from the emitted light beam that reflects off of an object within a second predetermined space, such as a space within a predetermined range or radius of the Lidar sensor, and back towards the Lidar sensor. Detecting reflected light may indicate the presence of a person within the second predetermined space, and monitoring changes in the reflection over time may indicate a change in position of the detected person over time. As the change in position is monitored, the changes may be processed in order to derive either or both of a speed and direction of the moving person. The use of Lidar-based motion detection allows for a speed and a direction of a person moving through the second predetermined space to be determined relatively fast and relatively accurately, as compared to object-recognition technologies that rely on image data. In other instances, other motion detection technologies, such as radar or sonar-based technologies, could be used to provide relatively fast motion detection. The presence of a person moving quickly through the second predetermined space may also indicate the potential for a shoplifting event, but may not be sufficient to activate an alarm, since activating an alarm every time a person were detected to be moving fast through the second predetermined space would similarly result in an undue number of false alarms.

At block 420, the controller 120 receives the collected EAS tag data 272 and TOF data 274 from the sensor unit 110. The controller may be located separate from the sensor unit, whereby the data may be transmitted over a wired or wireless connection, or a combination of the two. The controller may receive a constant stream of data from either or both of the EAS tag sensor 210 and the TOF sensor 220. For instance, the constant stream of data may indicate whether one or more tags are sensed by the EAS tag sensor at each given time, the number of tags sensed at each given time, the number of people detected by the TOF sensor at each given time, the position of each detected person at each given time, the speed of movement of each detected person at each given time, or a combination thereof. Alternatively, the controller may receive data intermittently, such as only at times that EAS tags or people are detected by the EAS tag sensor or TOF sensor, respectively. In some instances, receiving data at the controller may be even further restricted. For example, the TOF sensor may be programmed to transmit TOF data in response to an object detected by the TOF sensor moving faster than a threshold speed. In such an example, the TOF data received by the controller may be limited to indications of people moving relatively fast through the predetermined space surveilled by the TOF sensor.

At block 430, the controller 120 determines the speed of movement of the person from the TOF data 274 provided by the TOF sensor 220 at block 415. The TOF data received from the TOF sensor may be raw data indicating positions of the detected person at different points in time, and determining the speed of movement may involve processing the raw data to calculate a change in position over time to derive the speed of movement. Alternatively, the TOF data received from the TOF sensor may indicate the speed of movement. For instance, a processor at the TOF sensor (such as the sensor unit processor 226 shown in FIG. 2) may be capable of processing the raw data into speed data, and then transmitting the speed data to the controller. In such an example, for the controller to determine the speed based on the received data may involve processing the data without requiring any further calculations.

At block 435, the controller 120 determines whether a tag is present in the first predetermined space and whether the speed of movement of the person detected in the second predetermined space is greater than a threshold speed. The threshold speed may be a preset value corresponding to a speed at which it would be uncommon for a shopper in the shopping area to move. Such a threshold speed might indicate that the shopper is attempting to shoplift. Alternatively, the threshold speed may be a preset value corresponding to a speed at which it would be difficult for a security worker to catch a shoplifter if the alarm were to sound only after the shoplifter exits the shopping area. Such a threshold speed might indicate that the security worker needs a quicker start in pursuing the would-be shoplifter, whereas a quicker start would not be needed for shoppers moving at a slower pace.

If it is determined that either an EAS tag is not detected or the detected person is not moving above the threshold speed, then operations may continue at block 440, in which it is determined by the controller 120 that there is no theft event. In other words, without both the tag being detected and the person moving faster than the threshold, it may not be necessary to activate the alarm. For instance, if a shopper is running towards the exit of the shopping area but without holding an EAS tag, there is no need to activate the alarm. Therefore, monitoring speed of movement alone is not sufficient to activate an alarm. Likewise, if the shopper is slowly walking towards the exit of the shopping area while holding an EAS tag, there is also no need to activate the alarm prior to the shopper completely exiting the shopping area, since the shopper does not pose a risk of shoplifting. In such a case, the alarm may sound after the shopper leaves the area entirely. Alternatively, a loud alarm could be activated in response to a shopper that approaches an exit quickly, whereas a silent alarm could be transmitted to only security personnel in response to a shopper approaching the exit or exiting the shopping area slowly.

Conversely, if it is determined that an EAS tag is detected and the detected person is moving above the threshold speed, then operations may continue at block 450, in which it is determined by the controller 120 that there is a theft event. In this scenario, an alarm routine may be initiated. At least a part of the alarm routine may involve transmitting an instruction from the controller to an alarm located at or near the sensor unit 110. The instruction may cause the alarm to activate at block 460. Activation of the alarm may involve issuing a visual alert, an audio alert, or a combination thereof. Other activities in the alarm routine may involve logging the theft event either in a memory of the controller or another memory remotely connected to the controller, transmitting one or more alerts to locations other than the sensor unit, such as to a security worker station or security center, or controlling one or more exits of the shopping area to automatically close or lock.

Figure 5A:
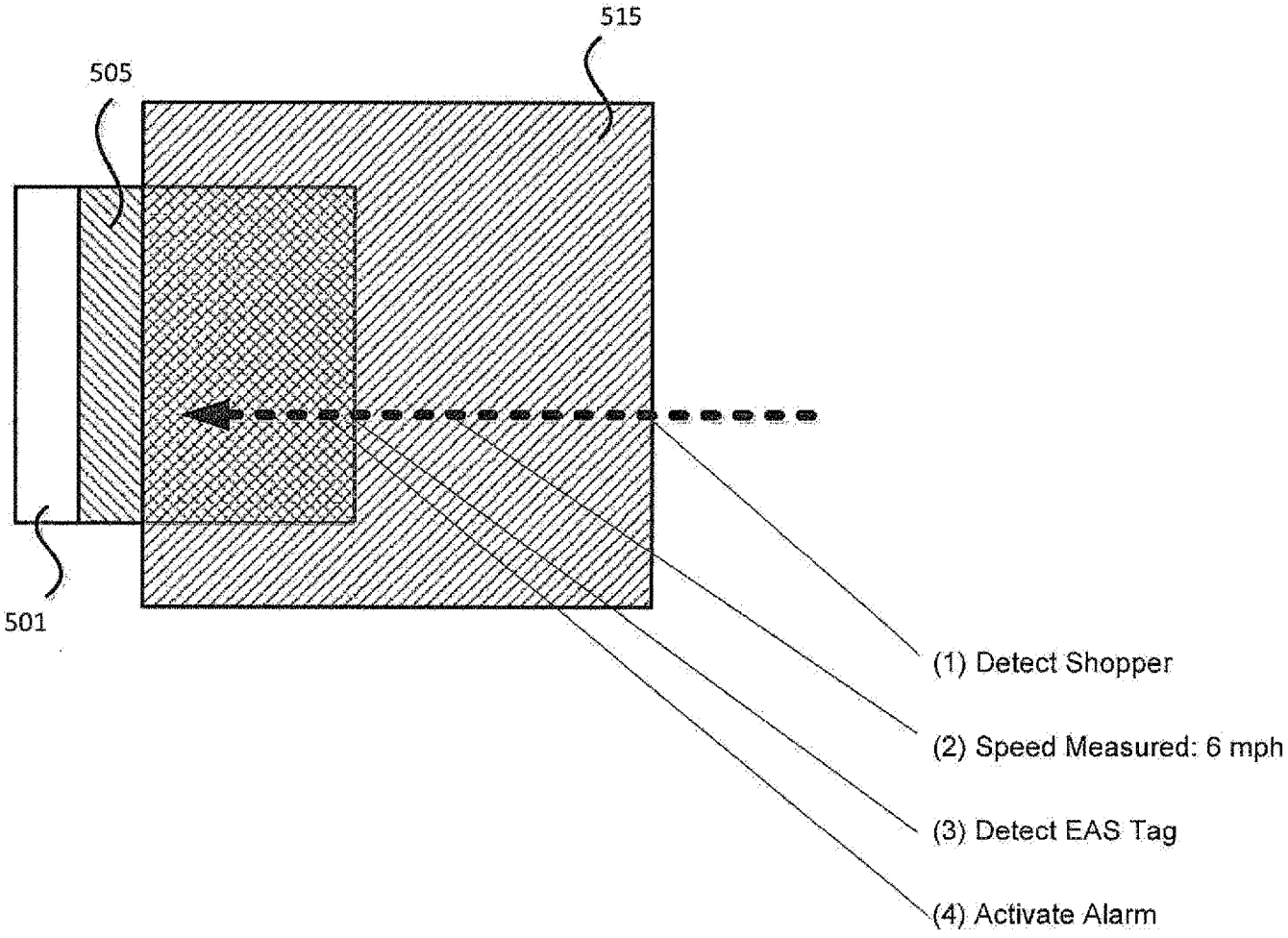
FIGS. 5A and 5B are diagrams mapping operations of the example method of FIG. 4 over a coverage map of an example sensor unit.
Figure 5B:
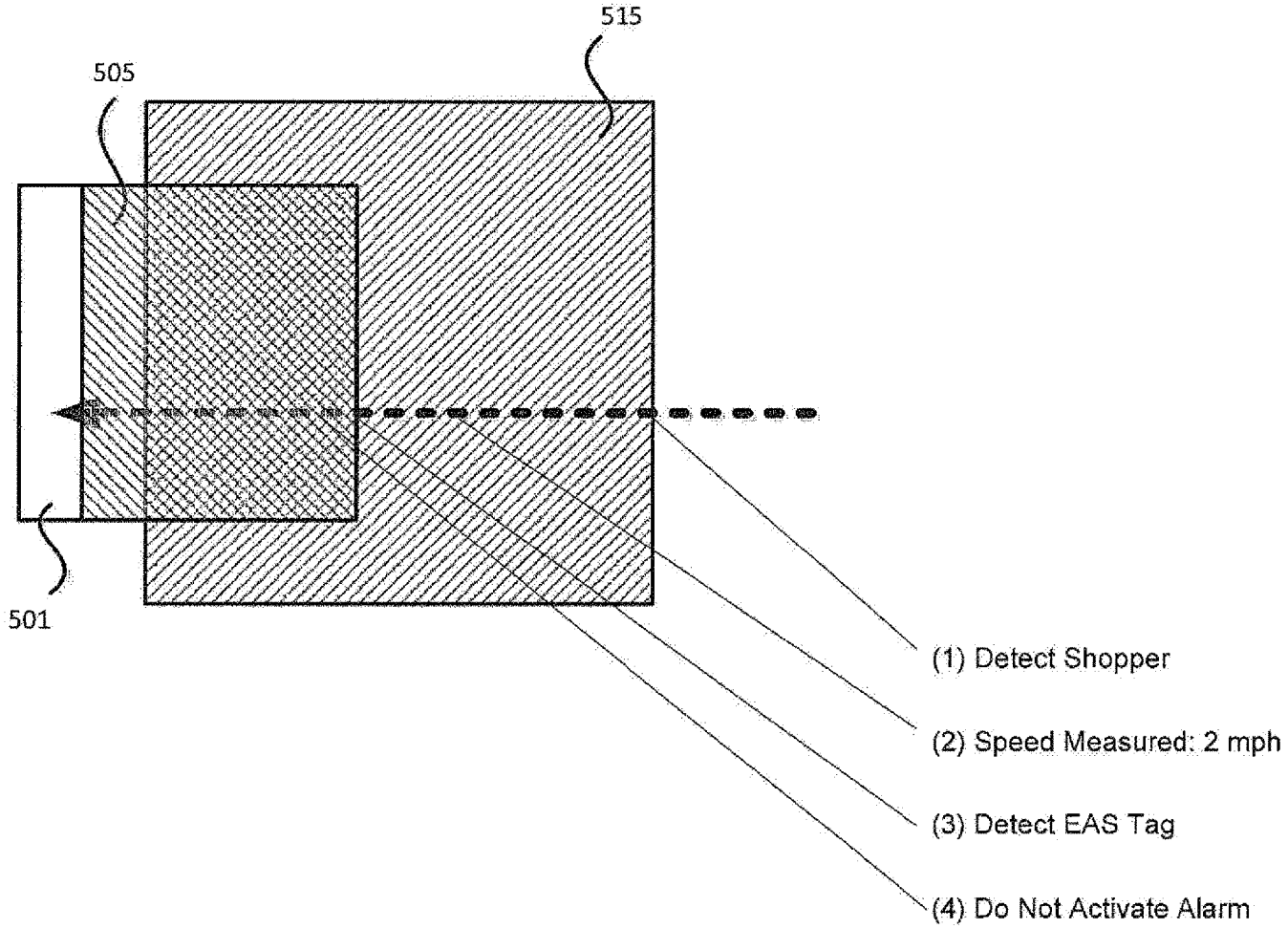

FIGS. 5A and 5B illustrate the operation of the routine 400 of FIG. 4. Each illustration is a top-down view of one or more predetermined spaces near an exit 501 of a shopping area, and depicts the motion of a person walking through the predetermined spaces 505, 515 using a dashed line.

In the example of FIG. 5A, a theft event is detected. As a person enters the predetermined space 515 monitored by the TOF sensor (1), the TOF sensor detects the presence of the person. Next, (2) the TOF sensor collects positional measurements of the person as the person moves through the predetermined space and determines that the person is moving at 6 mph. 6 mph is an unusually fast speed for a shopper, and is suggestive that the person may be attempting to shoplift. However, since it has not yet been determined whether the person is running out of the shopping area empty-handed or with merchandise, an alarm is not yet triggered. Next, as the person enters the predetermined space 505 of the EAS tag sensor, (3) the EAS tag sensor detects the presence of an EAS tag. As a result of an EAS tag being detected and the speed measurements of the person being above a preset threshold (e.g., 4 mph, 5 mph, etc.) (4) the system triggers an alarm to try to prevent the detected person from running out of the shopping area without paying for the merchandise attached to the detected EAS tag.

In the example of FIG. 5B, no theft event is detected. As the person enters the predetermined space 515 monitored by the TOF sensor (1), the TOF sensor detects the presence of the person. Next, (2) the TOF sensor collects positional measurements of the person as the person moves through the predetermined space and determines that the person is moving at 2 mph. 2 mph is a normal pace for a shopper, and is suggestive that the detected person is not attempting to shoplift. Next, as the person enters the predetermined space 505 of the EAS tag sensor, (3) the EAS tag sensor detects the presence of an EAS tag. However, since the TOF data indicates that the person is not running out of the shopping area, (4) the system determines to not trigger the alarm in response to detection of the EAS tag. As mentioned above, not triggering the alarm may still involve activating an alarm, but waiting until after the shopper exits entirely, sending a silent alarm to security personnel, or a combination thereof.

The above examples illustrate a surveillance method that relies on TOF data solely to determine speed of movement information. However, in other examples, other properties of the TOF data can be used to infer whether or not a shopper is likely to be a would-be shoplifter. For instance, the TOF data can be processed to derive changes in a shopper's movement throughout the predetermined space monitored by the TOF sensor. If a shopper were to abruptly turn towards an exit while moving through the predetermined space, change of direction data might be indicative of a potential theft event, even if the shopper is not moving fast. Conversely, if the shopper were running in front of the exit from one side to another but does not turn towards the exit, TOF data might indicate that the shopper is not attempting to leave the shopping area and that there is no potential theft event, even if the shopper is moving fast.

Figure 6:
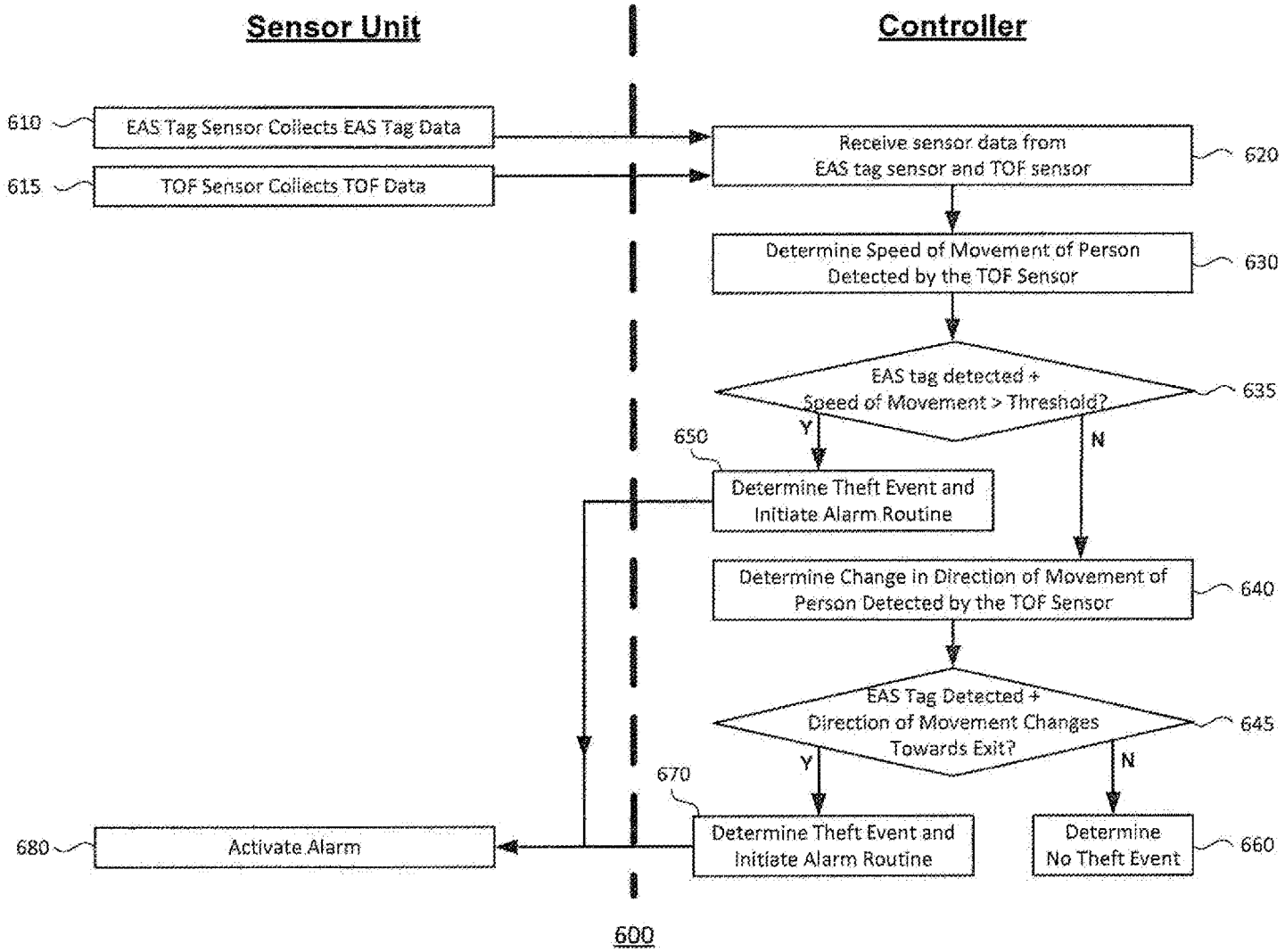
FIG. 6 is a flow diagram of an example method in accordance with another aspect of the disclosure.

FIG. 6 is a flow diagram showing another example routine 600 for monitoring a surveillance area with reduced false alarms using speed of movement and change of direction. The routine 600 of FIG. 6 bears some similarities to that of FIG. 4, except that the TOF data in routine 600 is used to monitor both speed of movement and change of direction of detected persons. Blocks 610, 615, 620, 630, 635 and 650 are comparable to blocks 410, 415, 420, 430, 435 and 450 of FIG. 4, respectively.

In FIG. 6, instead of operations ending at block 640 with a determination to not initiate an alarm routine (as performed in block 440 of FIG. 4), operations continue at block 640 with the controller 120 determining a change in the direction of movement of the person detected by the TOF sensor 220. Like the speed of movement determination, the TOF data 274 received from the TOF sensor may be either raw data indicating positions of the detected person at different points in time that are processed to calculate changes in direction over time, or the received TOF data may be preprocessed at the TOF sensor and may indicate the direction or even a change of direction of the person so that determining the change of direction may involve processing the data without requiring any further calculations.

At block 645, the controller 120 determines whether a tag is present in the first predetermined space and whether the direction of movement of the person detected in the second predetermined space changes towards the exit. The determination may be based on predefined values, such as directions that are known to head towards the exit, a threshold angle that amounts to a change of direction, such as 30 degrees, 45 degrees, 60 degrees, or 90 degrees for the sake of example, or both. The threshold angle may correspond to an angle at which it would be uncommon for a shopper in the shopping area to move as they exit the shopping area, and might indicate that the shopper is attempting to shoplift. Alternatively, the threshold angle may be any value for which it can be determined that the shopper has changed directions, such as 5 degrees, 10 degrees, 15 degrees and so on.

If it is determined that either an EAS tag is not detected or the detected person does not change direction towards the exit, then operations may continue at block 660, in which it is determined by the controller 120 that there is no theft event. In other words, without both the tag being detected and the person changing direction towards the exit, it may not be necessary to activate the alarm. For instance, if a shopper abruptly turns towards the exit but without holding an EAS tag, there is no need to activate the alarm. Therefore, monitoring change of direction alone is not sufficient to activate an alarm. Likewise, if the shopper is slowly walking in a straight path towards the exit while holding an EAS tag, there is also no need to activate the alarm prior to the shopper completely exiting the shopping area, since the shopper is not moving strangely and likely is not planning to abruptly change speed and run out of the store.

Conversely, if it is determined that an EAS tag is detected and the detected person changes direction towards the exit, then operations may continue at block 670, in which it is determined by the controller 120 that there is a theft event. In this scenario, the alarm routine may be initiated. The alarm routine may include activating the alarm at block 680 or any one or combination of activities described above in connection with block 450 of FIG. 4.

Figure 7A:
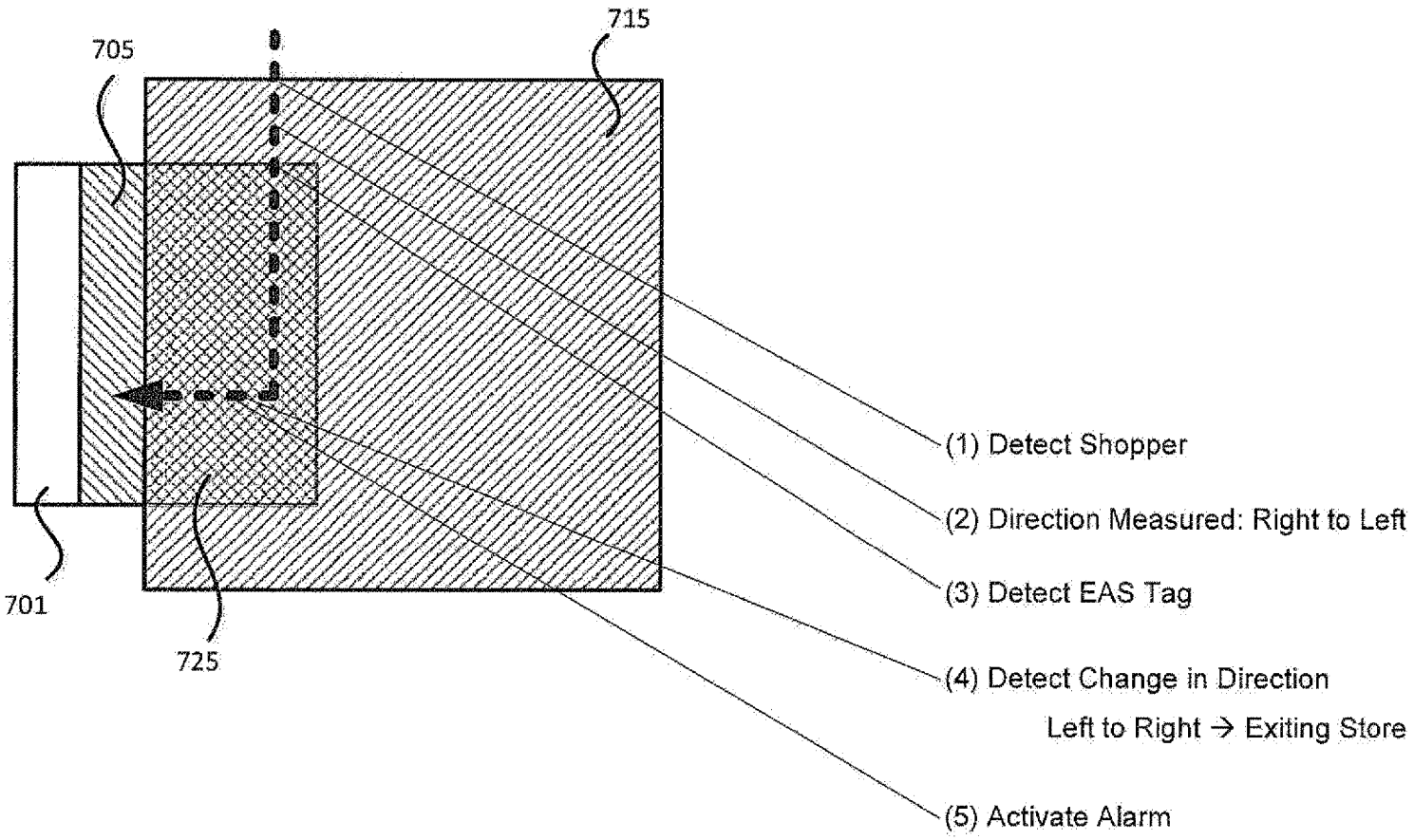
FIGS. 7A and 7B are diagrams mapping operations of the example method of FIG. 6 over a coverage map of an example sensor unit.
Figure 7B:
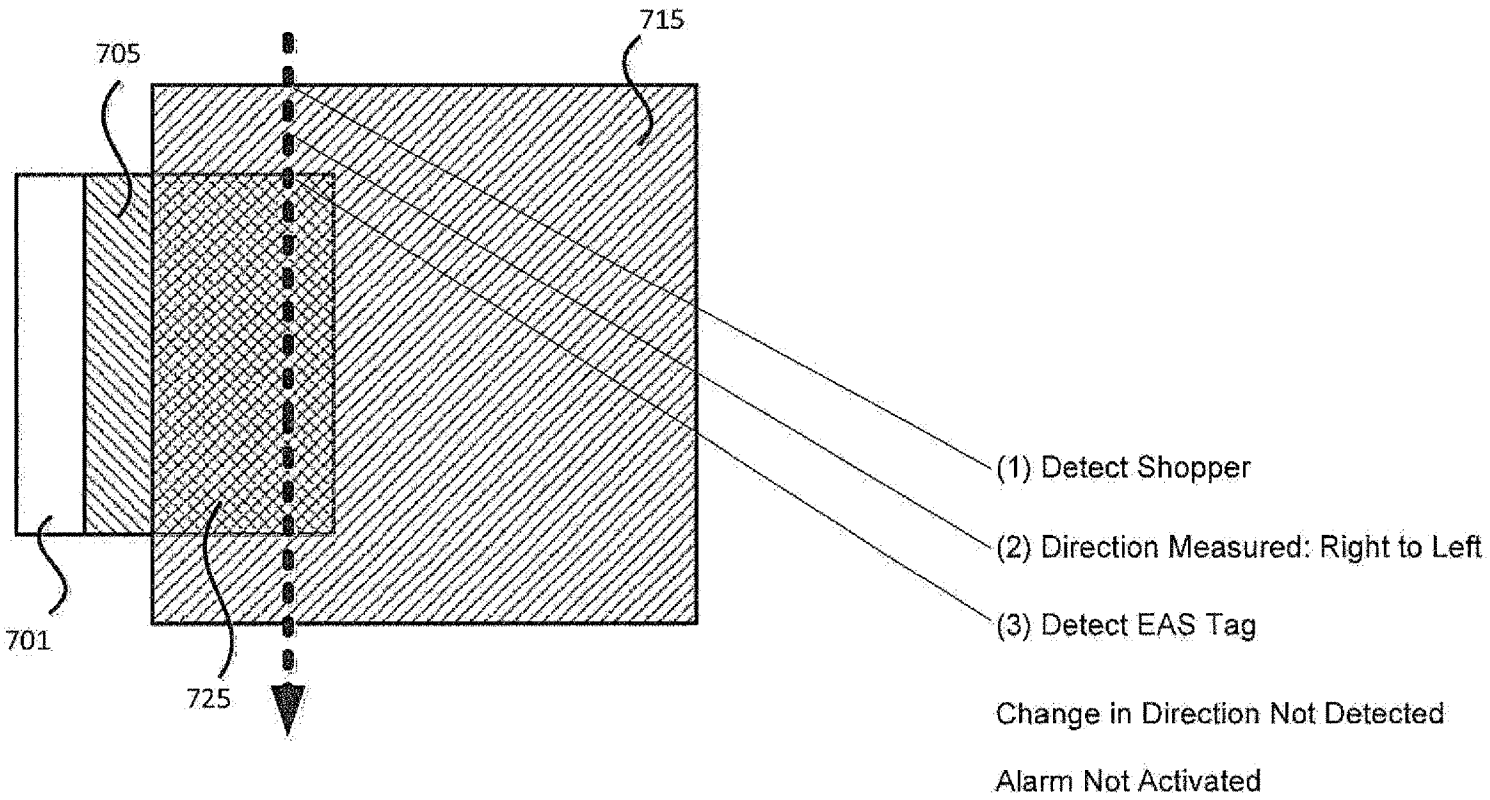

FIGS. 7A and 7B illustrate the operation of the routine 600 of FIG. 6, and particularly the portion of the routine that monitors a change in the direction of movement. Each illustration is a top-down view of one or more predetermined spaces near an exit 701 of a shopping area, and depicts the motion of a person walking through the predetermined spaces 705, 715 using a dashed line.

In the example of FIG. 7A, a theft event is detected. As a person enters the predetermined space 715 monitored by the TOF sensor, (1) the TOF sensor detects the presence of the person. Next, (2) the TOF sensor collects positional measurements of the person as the person moves through the predetermined space and determines that the person is moving right to left across the space, parallel to the exit 701. Next, as the person enters the predetermined space 705 of the EAS tag sensor, (3) the EAS tag sensor detects the presence of an EAS tag. Next, as the person turns to the right and towards the exit, (4) the TOF sensor detects a change of direction of the person from moving right-to-left through the space to moving towards the exit 701. In response to the detection of the EAS tag and the abrupt change of direction of the person, (5) the system triggers an alarm to try to prevent the person from running out of the shopping area without paying for the merchandise attached to the detected EAS tag.

In the example of FIG. 7B, no theft event is detected. As the person enters the predetermined space 715 monitored by the TOF sensor, (1) the TOF sensor detects the presence of the person. Next, (2) the TOF sensor collects positional measurements of the person as the person moves through the predetermined space and determines that the person is moving right to left across the space, parallel to the exit 701. Next, as the person enters the predetermined space 705 of the EAS tag sensor, (3) the EAS tag sensor detects the presence of an EAS tag. However, since the person continues walking from right to left through the predetermined space and does not turn towards the exit, the TOF data never detects a change of direction towards the exit, and the system does not trigger the alarm despite the detection of the EAS tag.

In the example routines and illustrations of FIGS. 4-7B, the system is configured to monitor speed and change of direction of a person independently. In other words, the detection of an EAS tag, along with either one of a person exceeding a threshold speed or a person changing their movement direction towards an exit, is used to detect a theft event. However, in other arrangements, the speed and change of direction data may be analyzed in combination. For instance, the controller may be configured to activate an alarm only if the person's speed is above a threshold and the person moves in a direction towards an exit. Other factors and considerations may be programmed into the controller, such as a first speed threshold that triggers the alarm in combination with a detected change of direction and a second speed threshold that triggers the alarm even without a detected change of direction, or such as a score indicating a likelihood of a theft event that is calculated based on both the speed of the person and a change of direction of the person (whereby the trigger may be activated when the score is high enough).

Also, the example routines and illustrations of FIGS. 4-7B generally describe monitoring and tracking a single person. However, in many circumstances, multiple EAS tags and/or people may be moving through a predetermined space at the same time. The TOF sensor may be capable of tracking multiple moving objects at the same time, whereby the TOF data collected by the sensor could be processed to detect people moving through the space monitored by the TOF sensor, and determine a speed and direction of each person, or both.

TOF data of multiple people is also useful for determining whether a theft event occurs. For instance, two people could be moving through the predetermined space monitored by the TOF sensor: a first person running in a direction that is not toward the exit; and a second person carrying an EAS tag and walking slowly towards the exit. The second person may enter a space monitored by the EAS tag sensor whereas the first person does not enter the space monitored by the EAS tag sensor. In such a case, the TOF sensor may detect the first person running, and the EAS tag sensor may separately detect the second person carrying the EAS tag. However, the controller may be able to determine from the TOF data to not initiate an alarm routine in response to the first person running since the first person is not running towards the exit and the EAS tag present in the EAS tag data is attributable to the second person. In other examples, the TOF data of multiple people could be used in other ways, such as detecting and logging multiple thefts.

Figure 8:
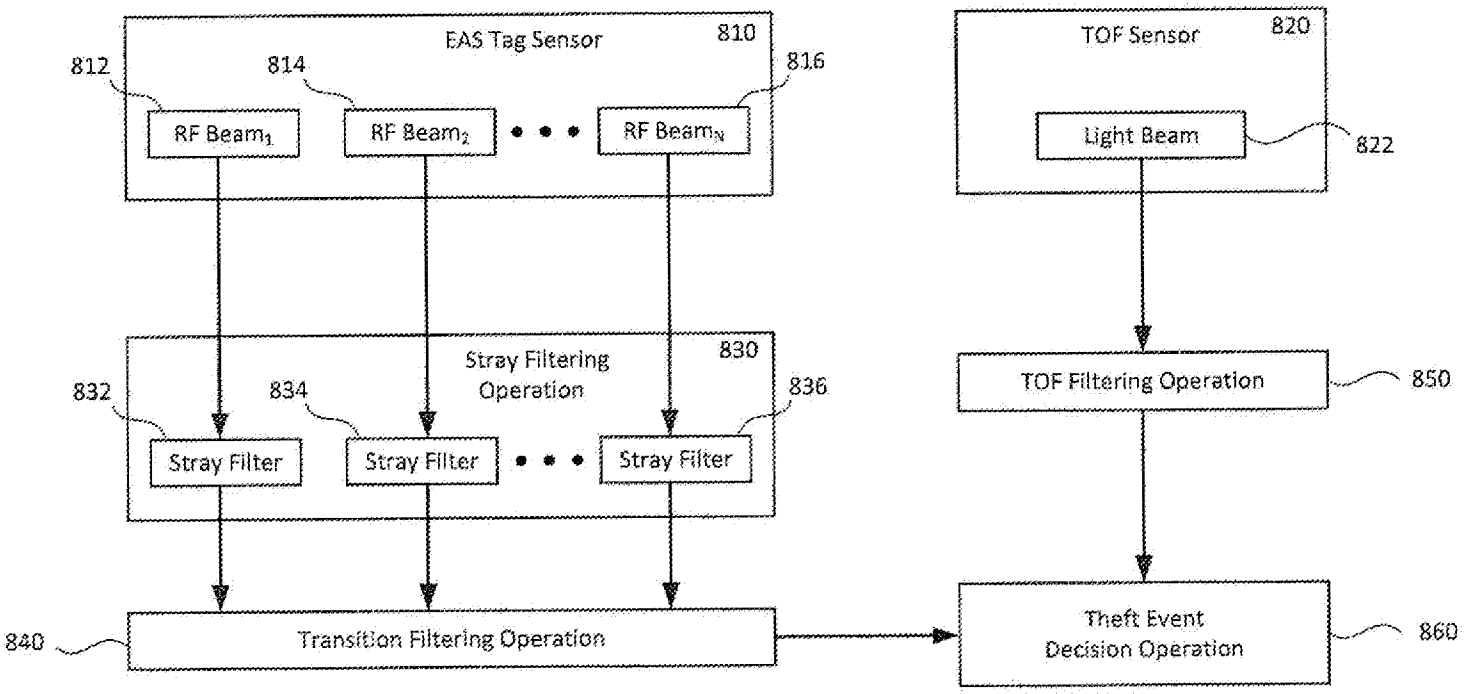
FIG. 8 is a functional diagram of sensing, filtering and detection operations in accordance with another aspect of the disclosure.

The above examples illustrate a surveillance method that uses EAS tag data to detect the presence of an EAS tag and relies on TOF data to determine speed of movement information. However, in other examples, EAS tag data can also be used to track motion of the tag and, by extension, a person carrying the tag. FIG. 8 is a functional block diagram showing a system 800 that uses both EAS tag data and TOF data to track motion and determine whether to activate an alarm based on the tracked motion.

In the example system 800 of FIG. 8, the EAS tag sensor 810 includes a plurality of radio frequency (RF) antennas, which may be controlled in order to steer a plurality of RF beams 812, 814, 816 to detect radio frequency identification (RFID) tags within a range of the sensor 810. Also, in the system 800, the TOF sensor 820 includes one or more emitters configured to emit light beams 822 to track moving objects within a range of the sensor 820.

Filtering operations on the RF data from the EAS tag sensor 810 can be performed by one or more processors in order to improve tracking. For instance, a respective stray filter operation 832, 834, 836 may be applied to RF data from each RF beam 812, 814, 816 of the EAS tag sensor 810. The stray filter 830 may filter out any stray signals received with each beam. This may be done by determining tag signal quality indicators for each RF antenna, each RF beam, or both, and then applying statistical calculations to the determined quality indicators in order to identify and potentially exclude any statistically anomalous RF data. For instance, the tag signal quality indicators may include any one or combination of a received signal strength indicator (RSSI), a phase of the received signal, or a frequency of the received signal. It should be noted that the frequency of the received signal may be subject to Doppler shifts since the RFID tag may be in motion. Statistical calculations performed on the tag signal quality indicators at the stray filter 830 may include determining a minimum value, a maximum value, a mean value, a standard deviation value, or a combination thereof. RF data that falls outside a predetermined window or range of tag signal quality indicators may be filtered out of the RF data to provide a stray filtered result.

For further example, a transition filtering operation 840 may be applied to the RF data. The transition filtering operation 840 may involve calculating an RFID tag location based on data received from the individual RF beams 812, 814, 816. For instance, the tag location may be derived from weighted RSSI information used along with a Kalman filter. The calculated RFID tag locations may further be processed to detect transitions of the tag location from one sector to another of the surveilled area of the EAS tag sensor 810.

The stray filter 830 and transition filter 840 may operate according to one or more predetermined parameters for performing the aforementioned calculations. For instance, a sample time window may be used to set a frequency of data sampling, a sample count may be used to set a number of samples to be evaluated in a filtering step, and threshold values may be set for each of the filters.

Filtering operations on the light beam data can also be performed by the one or more processors in order to improve tracking. For instance, a time-of-flight (TOF) filtering operation 850 may be applied to the received light data in order to more precisely calculate the location of the sensed object. This may be done by averaging TOF measurement values for multiple light beams reflected back towards the sensor. The calculated locations may further be processed to detect transitions of the object from one sector to another of the surveilled area of the TOF sensor 820. Predetermined parameters may also be set for the TOF sensor, including but not limited to a measurement time window to set a frequency of data sampling, and a threshold range or distance to set a farthest distance for tracking moving objects.

The filtered information from each of the EAS tag sensor 810 and the TOF sensor 820 can be combined in order to determine whether a theft event is occurring or not. This is represented in FIG. 8 by theft event decision operation 860. In the theft event decision operation 860, various factors determined by the sensors may be weighed as factors for determining an overall confidence factor for whether a theft event is occurring. These factors may include transitions between monitored sectors (which may indicate a direction of movement of the tag or tracked person), and/or a direction and/or speed of movement (which may indicate how fast either the tag or the person is moving toward the exit). These factors may be weighted, combined, or both according to known mathematical techniques. The particular way of combining the factors may vary depending on the setting of the sensors, such as a general direction of movement or general speed of regular shoppers in the monitored area.

In some examples, the theft event decision operation 860 may be executed by a machine-learning model. The machine-learning model may be a supervised model, whereby the model is trained on sample data of people walking close to or out of the exit of a shopping area, manual inputs of shoplifting events in the monitored shopping area, or both.

In some examples, additional factors may be included in the decision operation 860 in order to increase or decrease the likelihood of the system taking action in response to a theft event or not. For example, the information from the EAS tag sensor 810 may further include a total number of sensed tags, whereby the total number of tags may influence the likelihood of activating an alarm, or the distance of a person carrying the tags (as sensed by the TOF sensor) from the exit at which the alarm is activated. For instance, the alarm may be less likely to be triggered on account of a single tag detected near the exit, as compared to several tags being detected near the exit. For further example, the information from the TOF sensor 820 may further indicate a total number of people in proximity to or walking toward the exit, whereby the total number of sensed people may influence the likelihood of activating an alarm, the distance of these people from the exit at which the alarm is activated, a type of action or an order of multiple actions executed by initiation of the alarm, or any combination of the above. Such decisions may increase the likelihood of stopping shoplifting events by organized retail crime (ORC) involving multiple people. ORC events are typically more harmful since a much larger quantity of stock may be stolen, meaning that a sensitivity of the system may be increased when the sensor inputs indicate the presence of an ORC event. Furthermore, by classifying or identifying sensor inputs as ORC events, the system can increase its sensitivity in certain situations without having to increase its sensitivity in other situations, such when fewer people are detected around the exit. This can help to keep the number of false alarms relatively low while significantly improving protection against large-scale shoplifting attempts.

Theft detection decision operations in the example of FIG. 8 may resemble the operations described in connections with FIGS. 5A, 5B, 7A and 7B, except that movement of the detected shopper can be tracked in the predetermined spaces of both the EAS tag sensor and the TOF sensor and using both the tag data and the TOF data. For instance, if the EAS tag sensor data indicates that the EAS tag transitions between sectors of the predetermined space of the EAS tag sensor in a direction moving away from the exit, or alternatively in a direction that is not moving towards the exit, the data may factor against initiating a theft event and activating the alarm. Conversely, if the EAS tag sensor data indicates that the EAS tag transitions between sectors of the predetermined space of the EAS tag sensor in a direction moving towards the exit, or alternatively in a direction that is not moving away from the exit, the data may increase the likelihood of initiating the theft event and activating the alarm.

The above examples illustrate operations conducted around an exit having a predetermined space monitored by a single EAS tag sensor and another predetermined space monitored by a single TOF sensor. However, the same or similar operations may be conducted at exits having different sensor arrangements. For instance, the predetermined spaces may fully overlap with one another, or may have no overlap at all. Additionally or alternatively, the controller may receive sensor data from multiple EAS tag sensors, multiple TOF sensors, or both.

In the case of a controller receiving data from multiple EAS tag sensors or multiple TOF sensors, the controller may process and analyze the sensor data from each sensor unit separately, since each sensor unit may be associated with a different location of the shopping area. Alternatively, the sensor data from the multiple sensors may be combined to provide a more robust analysis by the controller. For example, a system could include multiple EAS tag sensors at different frequencies and a controller tunable to multiple frequency bands, so that if there is noise at the frequency of one sensor, reliable sensor data may still be collected from the other sensor. For further example, the system could include multiple types of EAS tag sensors, such as RFID and Bluetooth sensors. This may be advantageous since each sensor type may have an advantage over the other sensor types, such as operating at a different and less noisy frequency, having a larger range of operation, having a wider field of view, or any combination of the above. Additionally or alternatively, the sensors may be positioned so as to operate as an array, whereby the controller may be configured to combine and process data from multiple sensor units in order to analyze a wider area of the shopping location. For instance, two sensor units may be positioned adjacent to one another within the shopping area, such that an EAS tag or person moving out of the range of one sensor unit moves into the range of the other sensor unit. In such a case, combining data from the two sensor units can indicate the movement of an EAS tag between two adjacent predetermined spaces, the speed or direction of a person moving between the two predetermined spaces, or both. Each sensor unit may store identifying information, such as a code, readable by the controller or other components of the system to indicate. The identifying information may be used to identify which sensor unit is communicating. Each sensor may be further associated with its respective location, which may be used to construct the array for tracking movement between monitored spaces of different sensor units. Associating communications from a given sensor unit with a corresponding location may also be useful during initiation of the alarm routine, such as by notifying security personnel inside or outside the shopping area of a theft event location, actuating a specific alarm location, closing or locking a specific door or exit of the shopping area, and so on.

The figures of the present disclosure illustrate the surveillance of an area interior to an exit of a shopping area. However, it should be understood that the same principles and methods may be applied to monitor other regions, such as an area further inside the shopping area, an area within the exit itself, or an area just outside of the exit. The particular space monitored by a sensor unit may be chosen on a case-by-case basis to fit the particular security needs of a given exit, shopping area, or both.

Also, for those examples of the present disclosure in which the EAS tag sensor and TOF sensor do not monitor the same regions, the region monitored by the EAS tag sensor is typically shown as being closer to the exit than the region monitored by the TOF sensor. However, it should be understood that the principles and methods of the present disclosure are similarly applicable to systems in which the region monitored by the TOF sensor is closer to the exit than the region monitored by the EAS tag sensor. In such an arrangement, an EAS tag may be detected by the EAS tag sensor before the person is detected by the TOF sensor. After detection of a tag by the EAS tag sensor, the alarm may be activated immediately upon a suspicious movement detected by the TOF sensor.

Additionally, the examples of the present disclosure describe the EAS tag sensor and TOF sensor collecting and analyzing information about the presence of EAS tags and the motion of people moving through surveilled areas. However, the sensors may be capable of collecting additional information. For example, the TOF sensor may be capable of determining the height of a person moving through its respective surveilled area. The determined height may be useful for building a profile of a shoplifter, such as by storing the determined height, whereby security personal could later access the stored records in order to gain further information about the shoplifter. For further example, the TOF sensor may be capable of determining how many people are moving through its respective surveilled area. The determined number of people may be useful for ensuring that the alarm is not incorrectly activated, such as if one person enters the surveilled area shortly before another person exits the area.

Also, the examples of the present disclosure describe EAS tracking techniques using a combination of a tag sensing device, such as an RFID tag sensor, and a person-tracking device, such as a Lidar or other TOF sensor. However, it should be understood and appreciated that tag sensing is not limited to RFID, and that speed, distance and directionality tracking for people is not limited to Lidar or even to light-based TOF sensors. In other examples, RFID tag sensors may be replaced with or used along with acousto-magnetic tag sensors, Bluetooth tag sensors, or both. Also, in some examples, TOF sensors may be replaced with or used along with radar sensors. Radar sensors may differ from TOF sensors in that radio frequency signals instead of light signals are used to detect and track the presence, distance and size of objects. The information provided by the radar sensor to the controller may be processed in the same or similar fashion as the information provided by a TOF sensor. It should further be appreciated that any combination of RFID, Bluetooth, Lidar and radar technologies may be employed in the design of the systems and methods described herein to achieve the objectives of the present disclosure, such as monitoring of a surveillance area with reduced false alarms and without having to position the surveillance area as close as possible to, or even outside, the exit.

Furthermore, the examples of the present disclosure generally describe systems and methods of determining a direction and speed of a person or people exiting a shopping area. However, it should also be recognized that the same underlying concepts and technologies can be used to determine a direction and speed of those entering the shopping area.

Additionally, the examples of the present disclosure generally describe surveillance techniques using the EAS tag sensors and movement tracking sensors. However, this combination of sensors can be used in other ways. For example, when an item is stolen from the shopping area, the identification derived from the EAS tag and the determined theft event may be used to determine that the particular item has left the shopping area and update a database accordingly.

To summarize the foregoing, according to a first aspect of the disclosure an electronic article surveillance (EAS) system includes: one or more processors; and memory in communication with the one or more processors, wherein the memory contains instructions configured to cause the one or more processors to: receive first sensor data from a first sensor, the first sensor data indicating the presence of an electronic surveillance tag within a first predetermined space; receive second sensor data from a second sensor, wherein the second sensor data includes information that indicates a distance of the second sensor from a person in possession of the electronic surveillance tag within a second predetermined space; determine a speed of movement of the person based on the second sensor data; and detect a theft event and execute an alarm routine of the EAS system based on the presence of the electronic surveillance tag within the first predetermined space and the speed of movement of the person within the second predetermined space; and/or;

the first predetermined space may at least partially overlap the second predetermined space; and/or the first predetermined space may be fully within the second predetermined space; and/or the first predetermined space may include a surveilled exit, and the second predetermined space may include a region interior of the surveilled exit; and/or the second predetermined space may include a region interior of the first predetermined space; and/or the second predetermined space may not overlap with the first predetermined space; and/or the instructions may be further configured to cause the one or more processors to: determine a direction of movement of the person based on the second sensor data; and detect the theft event and execute the alarm routine of the EAS system when the direction of movement of the person is towards a surveilled exit of the EAS system; and/or the instructions may be further configured to cause the one or more processors to: determine a change in direction of movement of the person based on the second sensor data; and detect the theft event and execute the alarm routine of the EAS system when the presence of the electronic surveillance tag is detected within the first predetermined space and the change in direction of movement of the person is towards a surveilled exit of the EAS system; and/or the instructions may be further configured to cause the one or more processors to determine a direction of movement of the person based on the second sensor data, determine a distance of the person from a surveilled exit based on the second sensor data, and detect the theft event and execute the alarm routine based on a combination of the speed of the person, the direction of the person, and a distance of the person from the surveilled exit; and/or the instructions may be further configured to cause the one or more processors to input the speed of the person, the direction of the person, and a distance of the person from the surveilled exit into a trained machine-learning model, and detect the theft event and execute the alarm routine based on an output of the machine-learning model; and/or the instructions may be further configured to cause the one or more processors to detect a theft event in response to the speed of movement of the person within the second predetermined space being at or above a first predetermined threshold; and/or the instructions may be further configured to cause the one or more processors to: receive third sensor data from a third sensor, the third sensor data including information that indicates a distance of the third sensor from the person in possession of the electronic surveillance tag within a third predetermined space closer to a surveilled exit of the EAS system than the second predetermined space; determine a speed of movement of the person based on the third sensor data; and, in response to the presence of the electronic surveillance tag within the first predetermined space and the speed of movement of the person within the third predetermined space being at or above a second predetermined threshold that is higher than the first predetermined threshold, detect a theft event and execute the alarm routine of the EAS system; and/or the first sensor data may further include identification of a surveilled exit at which the first sensor is positioned, the second sensor data may further include identification of a surveilled exit at which the second sensor is positioned, and the instructions may be further configured to cause the one or more processors to: detect the theft event and execute the alarm routine of the EAS system based on the presence of the electronic surveillance tag within the first predetermined space of a first surveilled exit and the speed of the person within the second predetermined space of the first surveilled exit; and/or the instructions may be further configured to cause the one or more processors to: track movement of the electronic surveillance tag within the first predetermined space based on the first sensor data; and detect the theft event based at least in part on the tracked movement of the electronic surveillance tag within the first predetermined space.

According to another aspect of the disclosure, an EAS system includes: a first sensor positioned at a first surveilled exit and configured to: detect one or more electronic surveillance tags within a first predetermined space; and transmit first sensor data to a control circuit, the first sensor data indicating detection of an electronic surveillance tag within the first predetermined space; a second sensor positioned at the first surveilled exit and configured to: obtain information of one or more persons within a second predetermined space, the information at a given moment of time indicating a distance between the second sensor and a detected person at the given moment of time; and transmit second sensor data to the control circuit, the second sensor data indicating information of the detected person over a duration of time; and an alarm configured to receive, from the control circuit, an alarm activation instruction in response to the transmitted first and second sensor data indicating a theft event; and/or the first sensor may be one of an antenna configured to read passive RFID tags or a Bluetooth reader configured to read Bluetooth tags; and/or the second sensor may be a one of a Lidar sensor or a radar sensor; and/or the alarm may include at least one of: a light configured to activate in response to the alarm activation instruction; or a speaker configured to sound an alert in response to the alarm activation instruction; and/or the first and second sensors may be housed in a common housing; and/or the common housing may be mounted to or suspended from a ceiling of an interior space; and/or the first surveilled exit may be an exit of the interior space; and/or the common housing may be positioned between 8-15 feet above a floor of the interior space, and the second sensor may be configured to detect persons within at least a six-foot radius of a point on the floor directly beneath the common housing; and/or the system may further include multiple first sensors and multiple second sensors, each first sensor being positioned to detect electronic surveillance tags within a respective first predetermined space, and each second sensor being positioned to obtain information of one or more persons within a respective second predetermined space; and/or the multiple second sensors may include at least one RFID sensor and at least one Bluetooth sensor; and/or the system may further include the control circuit, whereby the control circuit may be configured to: receive the first sensor data from the first sensor and the second sensor data from the second sensor; determine occurrence of the theft event based on the presence of the electronic surveillance tag indicated by the first sensor data and a speed of movement of the detected person derived from the second sensor data exceeding a threshold speed; and transmit the alarm activation instruction to the alarm in response to occurrence of the theft event the system may further include; and/or the control circuit may be further configured to determine occurrence of the theft event based on at least one of a direction of movement of the detected person or a change in the direction of movement of the detected person derived from the second sensor data; and/or the control circuit may be further configured to determine occurrence of the theft event based further on at least one of a number of electronic surveillance tags indicated by the first sensor data, whereby a likelihood of the theft event increases as a function of the number of electronic surveillance tags or a number of detected persons indicated by the second sensor data, whereby the likelihood of the theft event increases as a function of the number of detected persons; and/or the control circuit may be further configured to transmit different alarm activation instructions based on at least one of the number of electronic surveillance tags or the number of detected persons; and/or the first sensor may include a plurality of RF antennas and may be configured to steer a plurality of RF beams emitted by the RF antennas, the first sensor data further indicating a movement of an electronic surveillance tag between predetermined sectors of the first predetermined space; and/or the first sensor may further include: a plurality of stray filters configured to filter the first sensor data received for each respective RF beam of the first sensor; and a Kalman filter configured to determine movement of an electronic surveillance tag between predetermined sectors of the first predetermined space based on the stray filtered first sensor data.

According to a further aspect of the disclosure, a method includes receiving, by one or more processors, first sensor data from a first sensor, the first sensor data indicating the presence of an electronic surveillance tag within a first predetermined space of a surveilled area; receiving, by the one or more processors, second sensor data from a second sensor, the second sensor data including information that indicates a distance of the second sensor from a person in possession of the electronic surveillance tag within a second predetermined space of the surveilled area; determining, by the one or more processors, a speed of movement of the person based on the second sensor data; detecting, by the one or more processors, a theft event based on the presence of the electronic surveillance tag within the first predetermined space and the speed of movement of the person within the second predetermined space; and issuing, by the one or more processors, an alarm activation instruction upon detection of the theft event.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

Most of the foregoing alternative examples are not mutually exclusive, but may be implemented in various combinations to achieve unique advantages. As these and other variations and combinations of the features discussed above can be utilized without departing from the subject matter defined by the claims, the foregoing description of the embodiments should be taken by way of illustration rather than by way of limitation of the subject matter defined by the claims. As an example, the preceding operations do not have to be performed in the precise order described above. Rather, various steps can be handled in a different order, such as reversed, or simultaneously. Steps can also be omitted unless otherwise stated. In addition, the provision of the examples described herein, as well as clauses phrased as "such as," "including" and the like, should not be interpreted as limiting the subject matter of the claims to the specific examples; rather, the examples are intended to illustrate only one of many possible embodiments. Further, the same reference numbers in different drawings can identify the same or similar elements.

The invention claimed is:

1. An electronic article surveillance (EAS) system, comprising:

one or more processors; and memory in communication with the one or more processors, wherein the memory contains instructions configured to cause the one or more processors to:

receive first sensor data from a first sensor, the first sensor data indicating the presence of one or more electronic surveillance tags within a first predetermined space;

receive second sensor data from a second sensor, wherein the second sensor data includes information that indicates a distance of the second sensor from one or more people in possession of the one or more electronic surveillance tags within a second predetermined space;

for each of the one or more people, determine a speed of movement of the person based on multiple data inputs from the second sensor data;

determine a score indicating a likelihood of occurrence of a theft event based at least in part on the presence of the one or more electronic surveillance tags within the first predetermined space and the determined speeds of movement of the one or more people within the second predetermined space; and determine whether to execute an alarm routine of the EAS system in response to occurrence of a theft event based on the determined score.

2. The EAS system of claim 1, wherein the first predetermined space at least partially overlaps the second predetermined space.

3. The EAS system of claim 2, wherein the first predetermined space is fully within the second predetermined space.

4. The EAS system of claim 1, wherein the first predetermined space includes a surveilled exit, and the second predetermined space includes a region interior of the surveilled exit.

5. The EAS system of claim 4, wherein the second predetermined space includes a region interior of the first predetermined space.

6. The EAS system of claim 5, wherein the second predetermined space does not overlap with the first predetermined space.

7. The EAS system of claim 1, wherein the instructions are further configured to cause the one or more processors to:

for each person of the one or more people, determine a direction of movement of the person based on the second sensor data; and determine the score based further on the determined direction of movement of the one or more people, wherein the direction of movement of the person being towards a surveilled exit of the EAS system corresponds to an increase in the likelihood of occurrence of the theft event.

8. An electronic article surveillance (EAS) system, comprising:

one or more processors; and memory in communication with the one or more processors, wherein the memory contains instructions configured to cause the one or more processors to:

receive first sensor data from a first sensor, the first sensor data indicating the presence of an electronic surveillance tag within a first predetermined space;

receive second sensor data from a second sensor, wherein the second sensor data includes information that indicates a distance of the second sensor from a person in possession of the electronic surveillance tag within a second predetermined space;

determine a speed of movement of the person based on multiple data inputs from the second sensor data; and detect a theft event and execute an alarm routine of the EAS system based on the presence of the electronic surveillance tag within the first predetermined space and the speed of movement of the person within the second predetermined space, wherein the instructions are further configured to cause the one or more processors to:

determine a change in direction of movement of the person based on the second sensor data; and detect the theft event and execute the alarm routine of the EAS system when the presence of the electronic surveillance tag is detected within the first predetermined space and the change in direction of movement of the person is towards a surveilled exit of the EAS system.

9. The EAS system of claim 1, wherein the instructions are further configured to cause the one or more processors to:

for each person of the one or more people, determine a direction of movement of the person based on the second sensor data;

for each person of the one or more people, determine a distance of the person from a surveilled exit based on the second sensor data; and determine the score based on a combination of the speeds of the one or more people, the directions of the one or more people, and the distances of the one or more people from the surveilled exit.

10. The EAS system of claim 9, wherein the wherein the instructions are further configured to cause the one or more processors to:

input the speeds of the one or more people, the directions of the one or more people, and the distances of the one or more people from the surveilled exit into a trained machine-learning model; and determine the score based on an output of the machine-learning model.

11. The EAS system of claim 1, wherein the instructions are further configured to cause the one or more processors to execute the alarm routine in response to the speed of movement of at least one person within the second predetermined space being at or above a first predetermined threshold.

12. The EAS system of claim 11, wherein the instructions are further configured to cause the one or more processors to:

receive third sensor data from a third sensor, wherein the third sensor data includes information that indicates, for at least one person of the one or more people, a distance of the third sensor from the person within a third predetermined space closer to a surveilled exit of the EAS system than the second predetermined space;

determine a speed of movement of the at least one person based on the third sensor data; and in response to the presence of the electronic surveillance tag within the first predetermined space and the speed of movement of the at least one person within the third predetermined space being at or above a second predetermined threshold that is higher than the first predetermined threshold, execute the alarm routine.

13. The EAS system of claim 1, wherein the first sensor data further includes identification of a surveilled exit at which the first sensor is positioned, the second sensor data further includes identification of a surveilled exit at which the second sensor is positioned, and the instructions are further configured to cause the one or more processors to:

execute the alarm routine based on the presence of the electronic surveillance tag within the first predetermined space of a first surveilled exit and the speed of at least one person within the second predetermined space of the first surveilled exit.

14. The EAS system of claim 1, wherein the instructions are further configured to cause the one or more processors to:

track movement of the electronic surveillance tag within the first predetermined space based on the first sensor data; and execute the alarm routine based at least in part on the tracked movement of the electronic surveillance tag within the first predetermined space.

15. An EAS system, comprising:

a first sensor positioned at a first surveilled exit and configured to: detect one or more electronic surveillance tags within a first predetermined space; and transmit first sensor data to a control circuit, wherein the first sensor data indicates detection of an electronic surveillance tag within the first predetermined space;

a second sensor positioned at the first surveilled exit and configured to: obtain information of one or more persons within a second predetermined space, wherein the information at a given moment of time indicates a distance between the second sensor and a detected person at the given moment of time; and transmit second sensor data to the control circuit, wherein the second sensor data includes multiple inputs collected over a duration of time and indicates a change in distance of the detected person over the duration of time; and an alarm configured to receive, from the control circuit, an alarm activation instruction in response to a score determined based on the transmitted first and second sensor data indicating meeting or exceeding a threshold value, wherein the score is indicative of a likelihood of occurrence of a theft event.

16. The EAS system of claim 15, wherein the first sensor is one of an antenna configured to read passive RFID tags or a Bluetooth reader configured to read Bluetooth tags, and wherein the second sensor is one of a Lidar sensor or a radar sensor.

17. The EAS system of claim 15, wherein the alarm includes at least one of:

a light configured to activate in response to the alarm activation instruction; or a speaker configured to sound an alert in response to the alarm activation instruction.

18. The EAS system of claim 15, wherein the first and second sensors are housed in a common housing.

19. The EAS system of claim 18, wherein the common housing is mounted to or suspended from a ceiling of an interior space, and the first surveilled exit is an exit of the interior space.

20. The EAS system of claim 19, wherein the common housing is positioned between 8-15 feet above a floor of the interior space, and the second sensor is configured to detect persons within at least a six-foot radius of a point on the floor directly beneath the common housing.

21. The EAS system of claim 15, further comprising multiple first sensors and multiple second sensors, wherein each first sensor is positioned to detect electronic surveillance tags within a respective first predetermined space, and each second sensor is positioned to obtain information of one or more persons within a respective second predetermined space.

22. The EAS system of claim 21, wherein the multiple second sensors include at least one RFID sensor and at least one Bluetooth sensor.

23. The EAS system of claim 15, further comprising the control circuit, wherein the control circuit is configured to:

receive the first sensor data from the first sensor and the second sensor data from the second sensor;

determine a score corresponding to occurrence of the theft event based on the presence of the electronic surveillance tag indicated by the first sensor data and a speed of movement of the detected person derived from the second sensor data exceeding a threshold speed; and transmit the alarm activation instruction to the alarm in response to the determined score corresponding to occurrence of the theft event.

24. The EAS system of claim 23, wherein the control circuit is further configured to determine the score based on at least one of a direction of movement of the detected person or a change in the direction of movement of the detected person derived from the second sensor data.

25. The EAS system of claim 23, wherein the control circuit is further configured to determine the score based further on at least one of:

a number of electronic surveillance tags indicated by the first sensor data, wherein the score increases as a function of the number of electronic surveillance tags; or a number of detected persons indicated by the second sensor data, wherein the score increases as a function of the number of detected persons.

26. The EAS system of claim 25, wherein the control circuit is further configured to transmit different alarm activation instructions based on at least one of the number of electronic surveillance tags or the number of detected persons.

27. The EAS system of claim 15, wherein the first sensor includes a plurality of RF antennas and is configured to steer a plurality of RF beams emitted by the RF antennas, wherein the first sensor data further indicates a movement of an electronic surveillance tag between predetermined sectors of the first predetermined space.

28. The EAS system of claim 27, wherein the first sensor further includes: a plurality of stray filters configured to filter the first sensor data received for each respective RF beam of the first sensor; and a Kalman filter configured to determine movement of an electronic surveillance tag between predetermined sectors of the first predetermined space based on the stray filtered first sensor data.

29. A method, comprising:

receiving, by one or more processors, first sensor data from a first sensor, the first sensor data indicating the presence of an electronic surveillance tag within a first predetermined space of a surveilled area;

receiving, by the one or more processors, second sensor data from a second sensor, the second sensor data including information that indicates a distance of the second sensor from a person in possession of the electronic surveillance tag within a second predetermined space of the surveilled area;

determining, by the one or more processors, a speed of movement of the person based on the second sensor data;

determining, by the one or more processors, a score indicating a likelihood of occurrence of a theft event based on the first sensor data and the second sensor data;

detecting, by the one or more processors, a theft event based on the score; and issuing, by the one or more processors, an alarm activation instruction upon detection of the theft event.

30. The EAS system of claim 1, wherein the instructions are further configured to cause the one or more processors to:

for each person of the one or more people, determine a change in direction of movement of the person based on the second sensor data; and determine the score based further on the determined change in direction of movement of the one or more people, wherein the direction of movement of the person changing towards a surveilled exit of the EAS system corresponds to an increase in the likelihood of occurrence of the theft event.

* * * * *